US005351071A

United States Patent [19]

Matsuda et al.

[11] Patent Number: 5,351,071

[45] Date of Patent: Sep. 27, 1994

[54] THERMAL PRINTER

[75] Inventors: Yasuhiro Matsuda; Takashi Yoshida; Isao Shimizu; Katsumi Watanabe, all of Ibaraki; Akira Shimizu, Katsuta; Masashi Yoshida, Nakaminato, all of Japan

[73] Assignee: Hitachi, Ltd., Tokyo, Japan

[21] Appl. No.: 578,459

[22] Filed: Sep. 7, 1990

[30] Foreign Application Priority Data

Sep. 8, 1989 [JP] Japan ..... 1-231609

[51] Int. Cl.[5] ..... B41J 15/00

[52] U.S. Cl. ..... 346/136; 346/76 PH; 400/614

[58] Field of Search ..... 400/614, 50, 611–613, 400/551, 719, 120, 568, 662; 346/136, 76 PH; 474/101

[56] References Cited

U.S. PATENT DOCUMENTS

| | | | |
|---|---|---|---|
| 4,551,729 | 11/1985 | Kubo et al. | 346/1.1 |
| 4,717,270 | 1/1988 | Tsutsumi | 400/120 |
| 4,829,320 | 5/1989 | Une et al. | 346/76 PH |
| 4,849,824 | 7/1989 | Sakugari et al. | 346/136 |
| 4,926,191 | 5/1990 | Takenaka et al. | 346/24 |
| 4,976,557 | 12/1990 | Uchikata | 400/568 |

FOREIGN PATENT DOCUMENTS

| | | | |
|---|---|---|---|
| 0019176 | 1/1984 | Japan | 400/120 |
| 0063460 | 4/1986 | Japan | 346/76 PH |
| 0177258 | 8/1986 | Japan | 346/76 PH |
| 0027167 | 2/1987 | Japan | 400/50 |

*Primary Examiner*—Benjamin R. Fuller
*Assistant Examiner*—N. Le
*Attorney, Agent, or Firm*—Antonelli, Terry, Stout & Kraus

[57] ABSTRACT

A thermal printer of the type printing an image on a printing paper wound in the form of a roll. Curling of the printing paper wound in the roll form occurs when the thermal printer is placed in its standby mode over more than a predetermined period of time while the printing paper is held between a platen roller and a thermal head. In order to prevent curling of the printing paper, the printing paper is rewound when the standby mode lasts over more than the predetermined period of time.

18 Claims, 19 Drawing Sheets

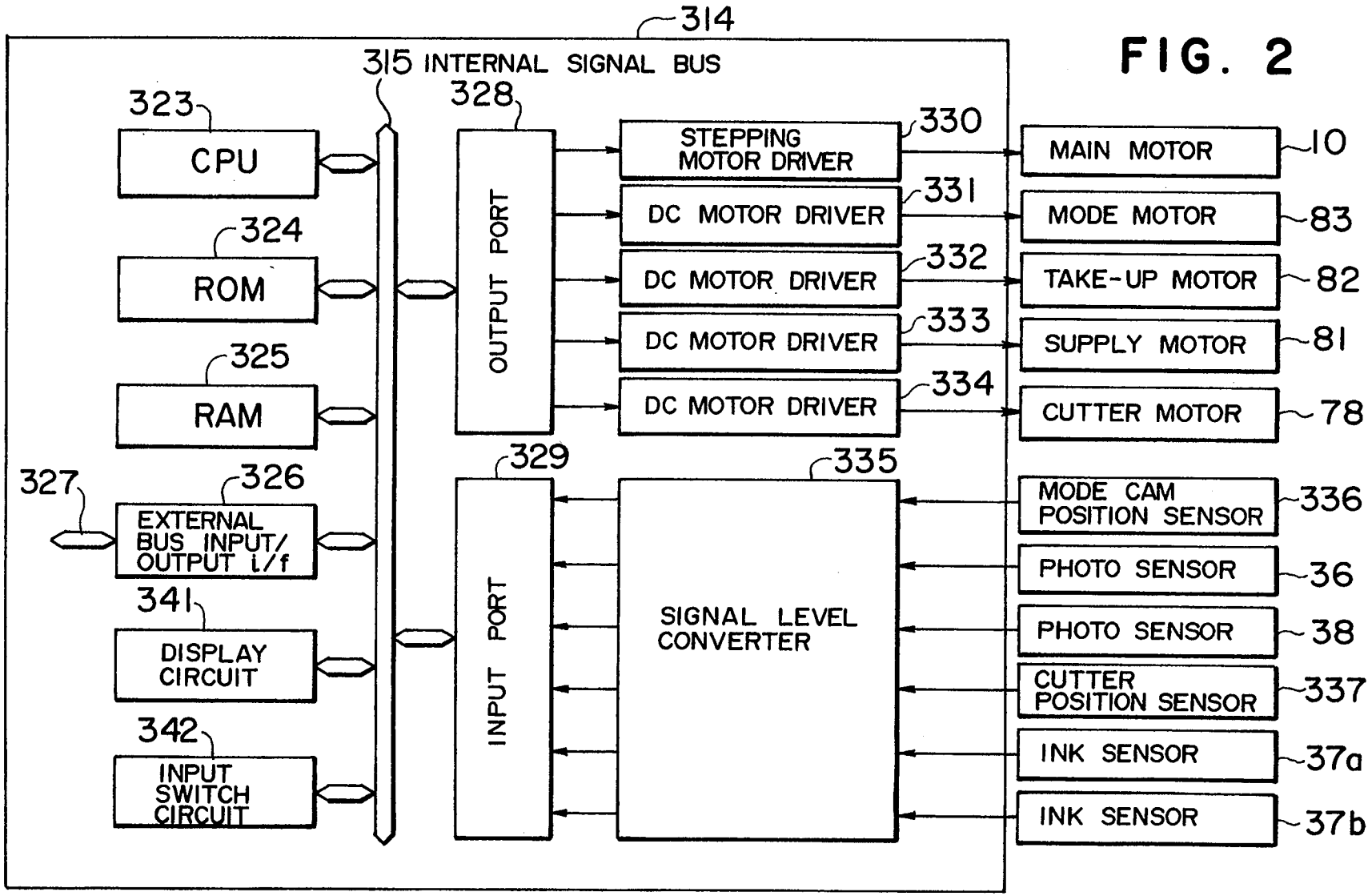
FIG. 2
MAIN MOTOR
10
MODE MOTOR
83
TAKE-UP MOTOR
82
SUPPLY MOTOR
81
CUTTER MOTOR
78
MODE CAM POSITION SENSOR
336
PHOTO SENSOR
36
PHOTO SENSOR
38
CUTTER POSITION SENSOR
337
INK SENSOR
37a
INK SENSOR
37b
STEPPING MOTOR DRIVER
330
DC MOTOR DRIVER
331
DC MOTOR DRIVER
332
DC MOTOR DRIVER
333
DC MOTOR DRIVER
334
SIGNAL LEVEL CONVERTER
335
314
INTERNAL SIGNAL BUS
315
OUTPUT PORT
328
INPUT PORT
329
CPU
323
ROM
324
RAM
325
EXTERNAL BUS INPUT/ OUTPUT I/f
326
327
DISPLAY CIRCUIT
341
INPUT SWITCH CIRCUIT
342

THERMAL PRINTER

BACKGROUND OF THE INVENTION

1. Field of the Invention

This invention relates to a thermal printer.

2. Description of the Related Art

A thermal printer is disclosed in, for example JP-A-60-38181, wherein a rigid and cylindrical capstan roller (transport roller) is used for transporting a printing paper. A head and wear-resistive material such as tungsten carbide is firmly coated on the surface of this transport roller by using, for example, a plasma jet. The printing paper is supplied from a supply roll (printing paper roll) having the printing paper wound therearound in the form of a roll, and a tension is always imparted to the printing paper being transported between the printing paper roll and a platen roller. In a standby mode, the printing paper passed between a thermal head and the platen roller is maintained in its stationary state with its leading end firmly held between the transport roller and a pinch roller (pressure applying roller). Generally, the thermal head has a flat surface in a vicinity of its heat generator part including an array of heat generator elements, and the printing paper pressed onto the thermal head in a print mode has inevitably a curvature at the heat generator part of the thermal head. In other words, the path of transporting the printing paper cannot generally be made straight in the vicinity of the heat generator part of the thermal head. For this reason too, the platen roller having a cylindrical shape is used in the prior art thermal printer as the part which is disposed opposite to the heat generator part of the thermal head so as to press the printing paper onto the heat generator part of the thermal head. The above fact indicates that a restraining force tending to cause curling of the printing paper by the curvature of the platen roller acts on the printing paper when the thermal printer is maintained in the standby mode.

SUMMARY OF THE INVENTION

The prior art thermal printer described above has had thus the problem that, because no consideration is given on the restraining force acting on the printing paper when the thermal printer is maintained in the standby mode, the printing paper is inevitably cur led when the standby mode lasts over a long period of time.

It is an object of the present invention to provide an improved thermal printer in which occurrence of an undesirable curl on the printing paper can be reliably prevented.

Another object of the present invention is to provide an improved thermal printer in which its thermal head can be prevented from damage, color misalignment can be prevented or minimized, and color nonuniformity of printed images can also be prevented.

According to the thermal printer of the present invention which attains the above objects, the printing paper is rewound to a position where the restraining force acting on the printing paper is released or minimized when the standby mode lasts over more than a predetermined period of time. Also, according to another aspect of the present invention, a heat roller is provided in the thermal printer so as to forcedly remedy or correct a curl occurred on the printing paper.

Other objects, features and advantages of the present invention will become apparent from the following detailed description taken in conjunction with the accompanying drawings.

BRIEF DESCRIPTION OF THE DRAWINGS

FIG. 2 is a block diagram of the system control circuit in the control unit of FIG. 1;

DESCRIPTION OF THE PREFERRED EMBODIMENTS

Figure 1:
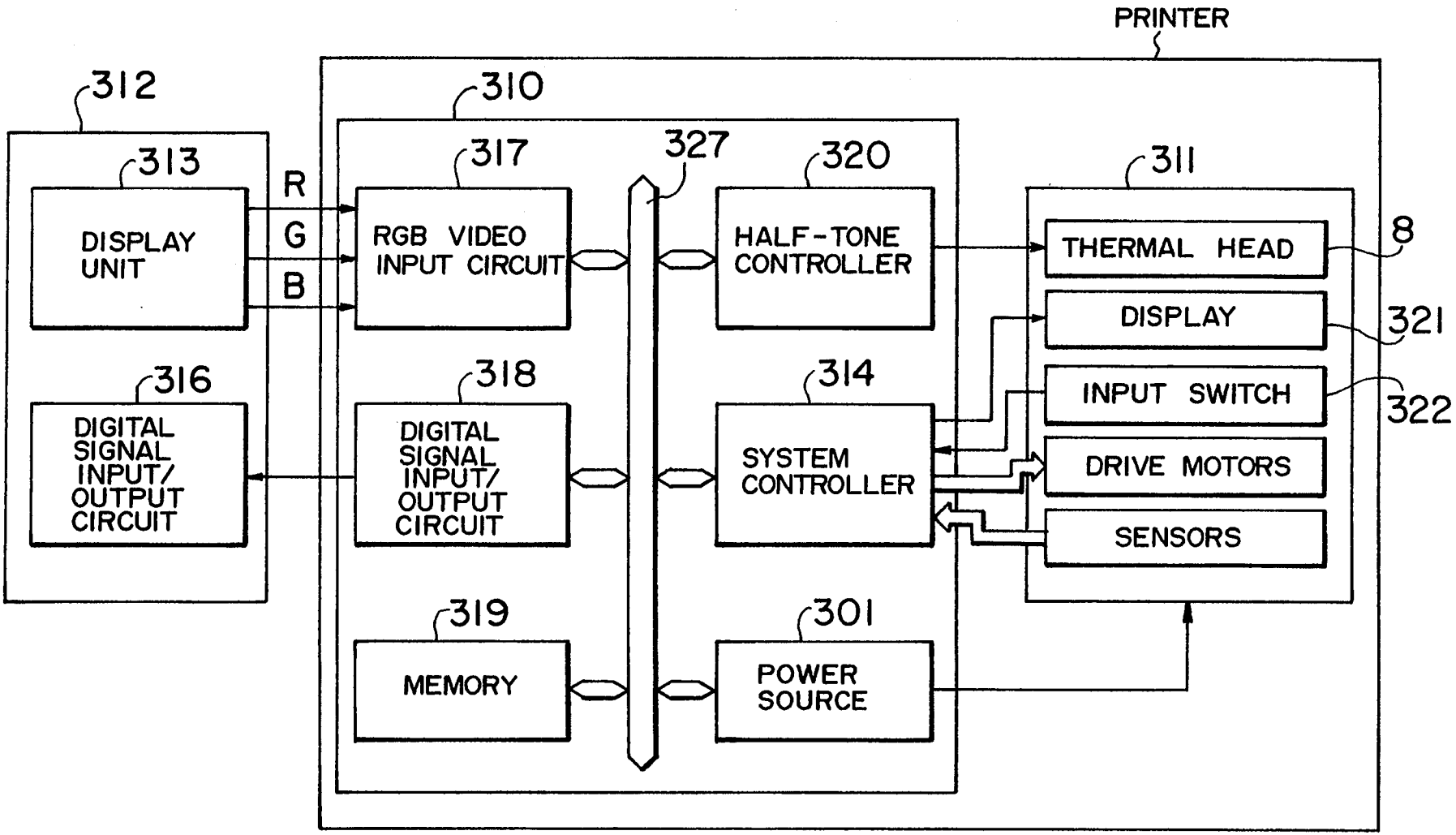
FIG. 1 is a block diagram of a control unit and printing system of a thermal printer for an image processor.

Referring to FIG. 1, the thermal printer, using sublimable dye ink for printing, comprises a control unit 310 and a printing system 311. The control unit 310 includes a power source 301, a system control circuit 314, an RGB video input interface circuit 317, a digital signal input/output interface circuit 318, a memory 319, a half-tone control circuit 320 and a data bus 27. The printing system 311 includes a thermal head 8, a display 321, an input switch 322, various drive motors including a main motor 10, a mode motor 83, etc. shown in FIG. 2, and various sensors including photo sensors 36, 8, ink sensors 37*a*, 37*b*, etc. shown in FIG. 2. An image processor 312 incorporated in, for example, a computer includes a display unit 313 such as a color CRT display and a digital signal input/output circuit 316.

Referring to FIG. 1, an image signal (a digital signal having a tone and referred to hereinafter as a tone data signal) is applied as an input to the digital signal input-/output interface circuit 318 in the control unit 310 from the digital signal input/output circuit 316 in the image processor 312. An RGB analog video signal is applied as an input to the RGB video input interface circuit 317 in the control unit 310 from the display unit 313 in the image processor 312. The RGB video input interface circuit 317 acts as an analog video input interface circuit which converts the RGB analog video input signal into a corresponding digital signal. The output signals of these interface circuits 317 and 318 appear on the data bus 327. The tone data described above designates data representing the density level indicating the depth of colors to be printed. When the half-tone control circuit 320 receives the tone data signal from the digital signal input/output interface circuit 318 or a tone data signal from the memory 319, the half-tone control circuit 320 produces a head control signal including a duty-cycle data signal and a duty-cycle pulse signal on the basis of the tone data signal, so as to selectively energize heat-generating resistor elements of the thermal head 8 according to the tone data thereby attaining a desired printing density.

Figure 3:
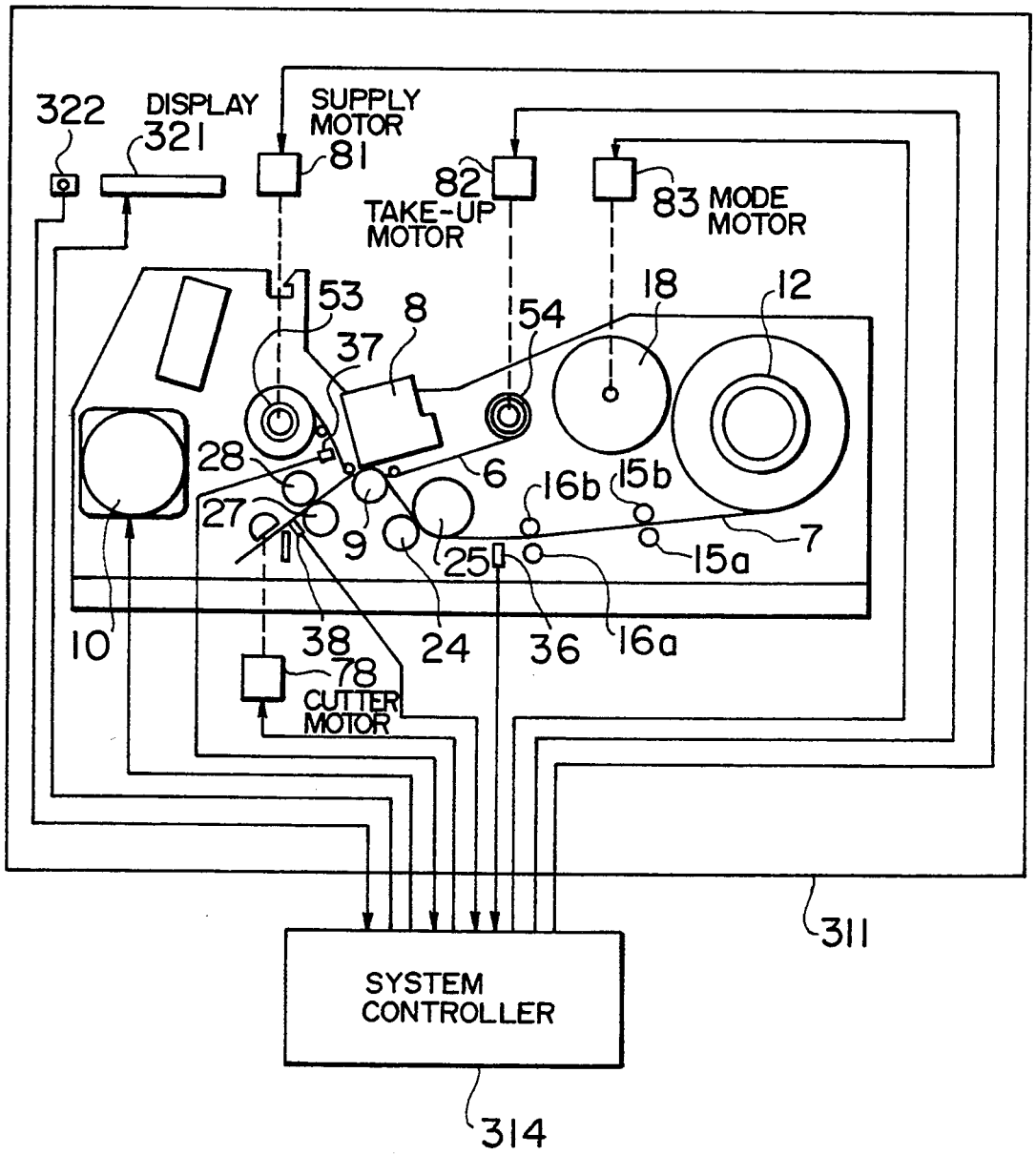
FIG. 3 is a schematic view showing a relation between the system control circuit and the printing system.

Because the transfer printing density of the sublimable dye ink used for image printing can be continuously controlled by the quantity of applied energy, the heat generation period time t of the heat-generating resistor elements of the thermal head 8 is controlled for each of individual tones. Thus, when the number of tones is n, the head control signal including n duty-cycle pulses having pulse widths $t_1, t_2, \ldots, t_n$ respectively is used to control the heat-generating resistor elements of the thermal head 8. The heat-generating resistor elements are arrayed in in-line relation on a substrate to compose the thermal head 8, and the quantities of heat generated from these heat-generating resistor elements are controlled respectively, so that the ink coated on an ink sheet 6 shown in FIG. 3 is heated from the side of a base film of the ink sheet 6 thereby causing penetration of the ink into or deposition of the ink on a printing paper 7 shown in FIG. 3. The quantities of heat generated from the heat-generating resistor elements of the thermal head 8 are controlled by the on-duration of the pulses of the head control signal and the voltage applied from the power source 301 to the thermal head 8. The temperature of the substrate of the thermal head 8 is measured by a head temperature sensor (not shown).

The system control circuit 314 controls the drive motors and the display 321 in the printing system 311 and also the power source 301 according to the external command signal applied through the digital signal input/output interface circuit 318 or according to an internal command signal applied from the input switch 322 commanding the printing conditions including the print starting timing and the size of images. Referring to FIG. 2, the system control circuit 314 controls the main motor 10, the mode motor 83, an ink-sheet take-up motor 82, an ink-sheet supply motor 81 and a cutter motor 78 in response to sensor output signals from the photo sensors 36 and 38 provided in the printing system 311 so as to sense the presence or absence of the printing paper 7, a mode cam position sensor 336 for sensing the position of a mode cam 18 (FIG. 3), the ink sensors 37*a* and 37*b* for sensing a mark indicating the color of the ink coated on the ink sheet 6, a sensor (not shown) for sensing whether or not an ink cassette is loaded in the printer, a sensor (not shown) for sensing whether or not a printing paper roll 12 (FIG. 3) is loaded in the printer, a sensor (not shown) for sensing rotation of an ink-sheet supply roll 53 (FIG. 3), a sensor (not shown) for sensing rotation of an ink-sheet take-up roll 54 (FIG. 3), and a cutter position sensor 337 for sensing the position of a cutter. The system control circuit 314 applies a page printing command signal, a line printing command signal and a color specifying signal to the data bus 327 so as to control the RGB video input interface circuit 317, the digital signal input/output interface circuit 318, the memory 319 and the half-tone control circuit 320.

The structure and operation of the system control circuit 314 will be now described in detail with reference to FIG. 2. The positions of the drive motors and the sensors are shown in FIG. 3.

The system control circuit 314 includes a microcomputer including a CPU (central processor unit) 23, a ROM ( read-only memory) 324, a RAM ( random access memory) 325, an output port 328, an input port 329 and an internal signal bus 315 connecting between them. The system control circuit 314 further includes a stepping motor drive circuit 330 driving the main motor 10, DC motor drive circuits 331, 332, 333 and 334 driving the mode motor 83, the ink-sheet take-up motor 82, the ink-sheet supply motor 81 and the cutter motor 78 respectively, a signal level conversion circuit 335 receiving the output signals from the sensors 336, 36, 38, 337, 37*a* and 37*b*, a display circuit 341, an input switch circuit 342, and an external bus input/output interface circuit 326.

The printing operation is started under control of the system control circuit 314 in response to a printing command signal transferred from the digital signal input/output circuit 316 in the image processor 312 to the digital signal input/output interface circuit 318 in the control unit 310 and appearing then on the data bus 327 or in response to a printing command signal applied from the input switch circuit 342. The operation of the system control circuit 314 is controlled according to a program stored already in the ROM 324 to instruct a sequence of operation steps. The CPU 323 decodes this program and executes arithmetic and logical processing of data. The CPU 323 controls also output of data from the output port 328 and input of data to the input port 329. The RAM 325 is used to print the results of arithmetic and logical processing of the data, to store the input data and to store the output data.

One of the output signals from the output port 328 is applied to the stepping motor drive circuit 330 so as to control the main motor 10 which is a stepping motor. The other output signals from the output port 328 are applied to the DC motor drive circuits 331, 332, 333 and 334 so as to control the mode motor 83, the ink-sheet take-up motor 82, the ink-sheet supply motor 81 and the cutter motor 78 all of which are DC motors respectively. The output signal from the mode cam position sensor 336 which is in the form of a contact switch, the output signals from the photo sensors 36 and 38 which are of the reflection type, the output signal from the cutter position sensor 337 which is in the form of a contact switch and the output signals from the ink sensors 37*a* and 37*b* which are of the reflection type are applied to the level conversion circuit 335 which converts the sensor output signals into logic level signals. These logic level signals are applied through the input port 329 to the microcomputer. The ink sensors 37*a* and 37*b* will be merely referred to hereinafter as an ink sensor 37.

Figure 4:
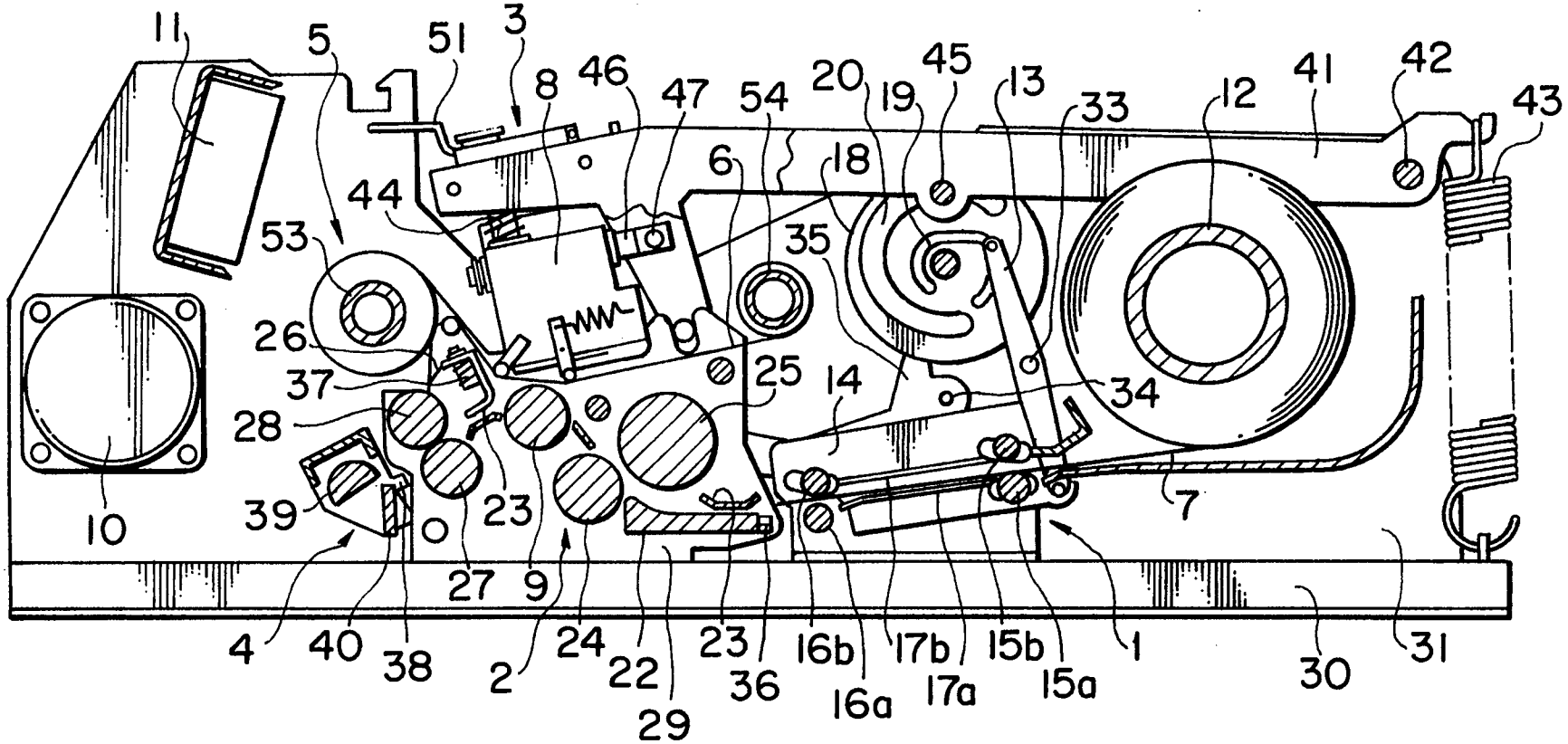
FIG. 4 is a cross-sectional side elevational view of the printing system.

Referring to FIG. 4, the printing system 311 includes a bottom plate 30 and a pair of spaced side plates 31 and 31' vertically fixed to the bottom plate 30. In FIG. 4, the side plate 31 is only shown. A printing-paper feed block 1 and a printing-paper transport block 2 are firmly fixed by bolts to the bottom plate 30. A head block 3, a cutter block 4, the main motor 10 and a cooling fan 11 are mounted between the side plates 31 and 31'. An ink block 5 in the form of an ink cassette is supported by ink bearings (not shown) mounted on the side plates 31 and 31'. A printing paper roll 12 is mounted between the side plates 31 and 31' in a manner similar to the manner of mounting the ink block 5. A printing paper 7 supplied from the printing paper roll 12 is fed through the printing-paper feed block 1, the printing paper transport block 2 and the cutter block 4 before it is delivered from the printing system 311.

The printing-paper feed block 1 includes two pairs of paper feeding means, that is, one pair of front paper feed rollers 15*a*, 15*b* and one pair of rear paper feed rollers 16*a*, 16*b*, and paper guides 17*a*, 17*b*. A paper feed frame 14 is urged rightward and leftward when a paper feed lever 13 rotates around a pivot pin 33 by being guided along a groove 19 formed on a mode cam 18. As a result, the front paper feed roller 15*b* and the rear paper feed roller 16*b* are urged in the vertical direction to be moved toward or away from the front paper feed roller 15*a* and the rear paper feed roller 16*a* respectively.

The printing-paper transport block 2 includes paper guides 22, 23, one pair of paper transporting means, that is, a paper transport roller 24 forming a pair with a pressure applying roller 25, a platen roller 9, and a paper delivery roller 27 forming a pair with a pressure applying roller 28. The rollers in the transport block 2 are rotatably mounted on roller chassis 29 and 29', while the paper guides in the transport block 2 are fixed by bolts to the roller chassis 29 and 29'. (In FIG. 4, the roller chassis 29 only is shown.) The pressure applying roller 25 is composed of a hollow cylindrical roller body 25*a* (not shown) journalled in rolling bearings and an eccentric shaft 25*b* (not shown) inserted in the hollow cylindrical roller body 25*a*. A pressure applying lever 35 is mounted on each end of the eccentric shaft 25*b*. Each of these pressure applying levers 35 swings around a pivot pin 34 by being guided along an associated groove 21 (not shown) formed on the cam 18, so that the eccentric shaft 25*b* is rotated. As a result, the pressure applying roller 25 is urged toward or away from the transport roller 24. In the illustrated printing system 311, the force applied from the pressure applying roller 25 to the transport roller 24 is selected to be 0.9 to 1.6 Kgf/cm$^2$. The pressure applying roller 25 is a follower roller which rotates when it is brought into pressure engagement with the transport roller 24 and has a length approximately equal to that of the transport roller 24. This length is larger than the width of the printing paper 7. The pressure applying roller 25 is a single cylindrical roller having a smooth surface not having any stepped portions or any grooves. The transport roller 24 is a rigid cylindrical roller made of a material such as a stainless steel, and fine particles of a ceramic material are bonded at random to its surface so as to increase the coefficient of friction with the printing paper 7. The hardness of the particulate ceramic material is less than the hardness (Vickers hardness: 1,600 to 1,800 Hv) of the surface of the heat-generating resistor elements of the thermal head 8 and is selected to be 1,400 to 1,500 Hv in Vickers hardness. When the particle size of the particulate ceramic material is nonuniform, the out-of-roundness and the cylindricality of the transport roller 24 become unsatisfactory. Therefore, the allowance of the size of the particulate ceramic material bonded to the surface of the transport roller 24 is selected to be $\pm 10$ $\mu$m. A leaf spring 26 mounted on the paper guide 22 normally urges the pressure applying roller 28 toward the delivery roller 27. The photo sensor 36 for sensing the presence or absence of the printing paper 7 is mounted on the paper guide 22, and the ink sensor 37 for sensing the mark indicating the color of the ink sheet 6 is mounted on the paper guide 23.

The cutter block 4 includes a rotary knife 39, a stationary knife 40 and the photo sensor 38 for sensing the presence or absence of the printing paper 7. The printing paper 7 fed into the gap between the rotary knife 9 and the stationary knife 40 is cut by rotation of the rotary knife 39.

In the head block 3, the thermal head 8 is mounted on the left-hand end of a head arm 41, and a pivot shaft 42 is provided at the right-hand end of the head arm 41, so that the head arm 41 swings around the pivot shaft 42 to raise the head block 3. The shaft 42 is rotatably mounted between the side plates 31 and 31'. Also, the thermal head 8 is swingably supported on a rotary shaft 46 which is fixed to a head mounting member 47, and the head mounting member 47 is swingably mounted on the head arm 41. A coil spring 43 mounted between the right-hand end of the head arm 41 and the bottom plate 30 has a holding force capable of raising the head block 3. The head block 3 can be swung to a position where the head arm 41 extends vertically with respect to the horizontal. A coil spring 44 provides a force for pressing the thermal head 8 against the platen roller 9. This coil spring 44 is interposed between the upper surface of the thermal head 8 and the lower surface of a top plate 51 fixed to the head arm 41. A pin 45 mounted at the middle position of the head arm 41 can move in the vertical direction by being guided along the groove 20 of the cam 18 with the rotation of the cam 18. This movement of the pin 45 causes vertical movement of both the head arm 41 and the top plate 51, and the coil spring 44 is compressed or released thereby imparting or releasing the head pressurizing force.

The ink block 5 includes an ink-sheet supply roll 53 around which an unused portion of the ink sheet 6 is wound, and an ink-sheet take-up roll 54 for taking up a used portion of the ink sheet 6. Sublimable dye inks of three or four colors (yellow: Y color, majenta: M color, cyan: C color and/or black: B color) are sequentially coated on the surface of a sheet to provide the ink sheet 6.

Figure 5:
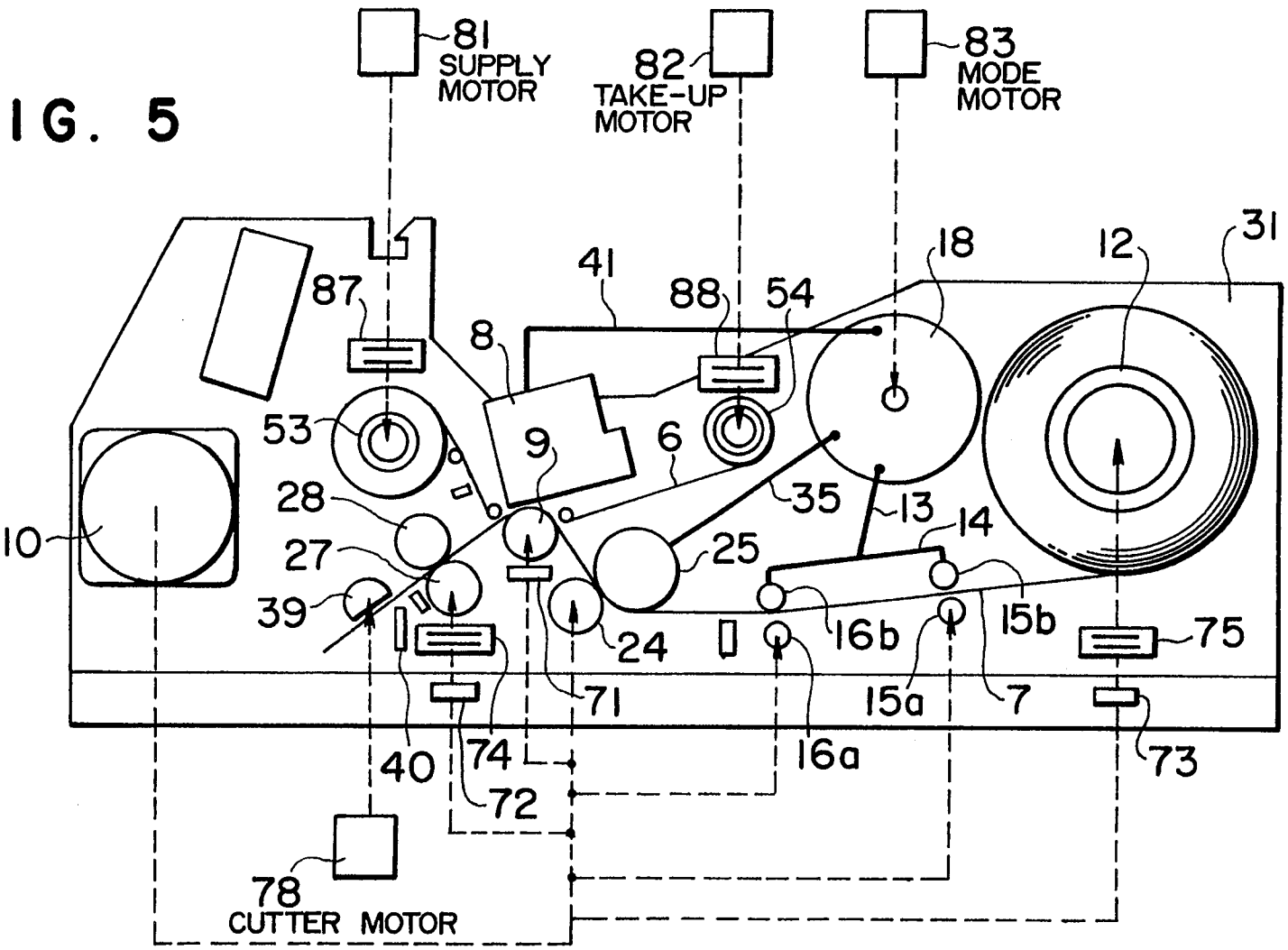
FIG. 5 is a schematic view of a driving mechanism in the printing system.

As shown in FIG. 5, the drive power generated from the main motor 10 mounted between the side plates 31 and 31' is transmitted through a power transmission mechanism to the paper transport roller 24, the platen roller 9, the paper delivery roller 27, the front paper feed roller 15*a*, the rear paper feed roller 16*a* and the printing paper roll 12. The main motor 10 drives the paper transport roller 24 through a timing belt 58 described later. When the drive power of the main motor 10 is transmitted through the power transmission mechanism to the paper transport roller 24, the paper transport roller 24 acts to transmit the drive power in one direction only (the direction of supplying the printing paper 7 from the printing paper roll 12) through one-way clutches 71 and 72. The platen roller 9 and the paper delivery roller 27 are similar to the paper transport roller 24 in that they act also as paper transporting means. The paper delivery roller 27 has a friction clutch 74 mounted on its shaft. In the print mode printing data on the printing paper 7, the frictional torque of this friction clutch 74 acts to impart a tension to the printing paper 7 in a direction opposite to the moving direction of the printing paper 7. The value of this frictional torque is suitably selected so that the tension described above is larger than the front tension imparted to the ink sheet 6 when the used portion of the ink sheet 6 is taken up on the ink-sheet take-up roll 54.

In the case of the front paper feed roller 15*a*, the rear paper feed roller 16*a* and the printing paper roll 12 too, the drive power is transmitted from the paper transport roller 24. As in the case of the paper delivery roller 27, the printing paper roll 12 has a friction clutch 75 mounted on its shaft.

The supply motor 81 and the take-up motor 82 mounted between the side plates 31 and 31' drive the ink-sheet supply roll 53 and the ink-sheet take-up roll 54 through associated power transmission means and friction clutches 87 and 88 respectively. The ink sheet 6 supplied from the supply roll 53 passes between the thermal head 8 and the platen roller 9 to be taken up on the take-up roll 54. That is, the ink sheet 6 is transported by the transporting means described above. The cam 18, acting to respectively move the thermal head 8, the pressure applying roller 25, the front paper feed roller 15*b* and the rear paper feed roller 16*b* toward and away from the platen roller 9, the paper transport roller 24, the front paper feed roller 15*a* and the rear paper feed roller 16*a*, is driven by the mode motor 83 mounted on the side plate 31. The rotary knife 39 cutting the printing paper 7 is driven by the cutter motor 78 mounted on the side plate 31.

The operation of the first embodiment will now be described in detail with reference to FIGS. 6 to 15.

Figure 6:
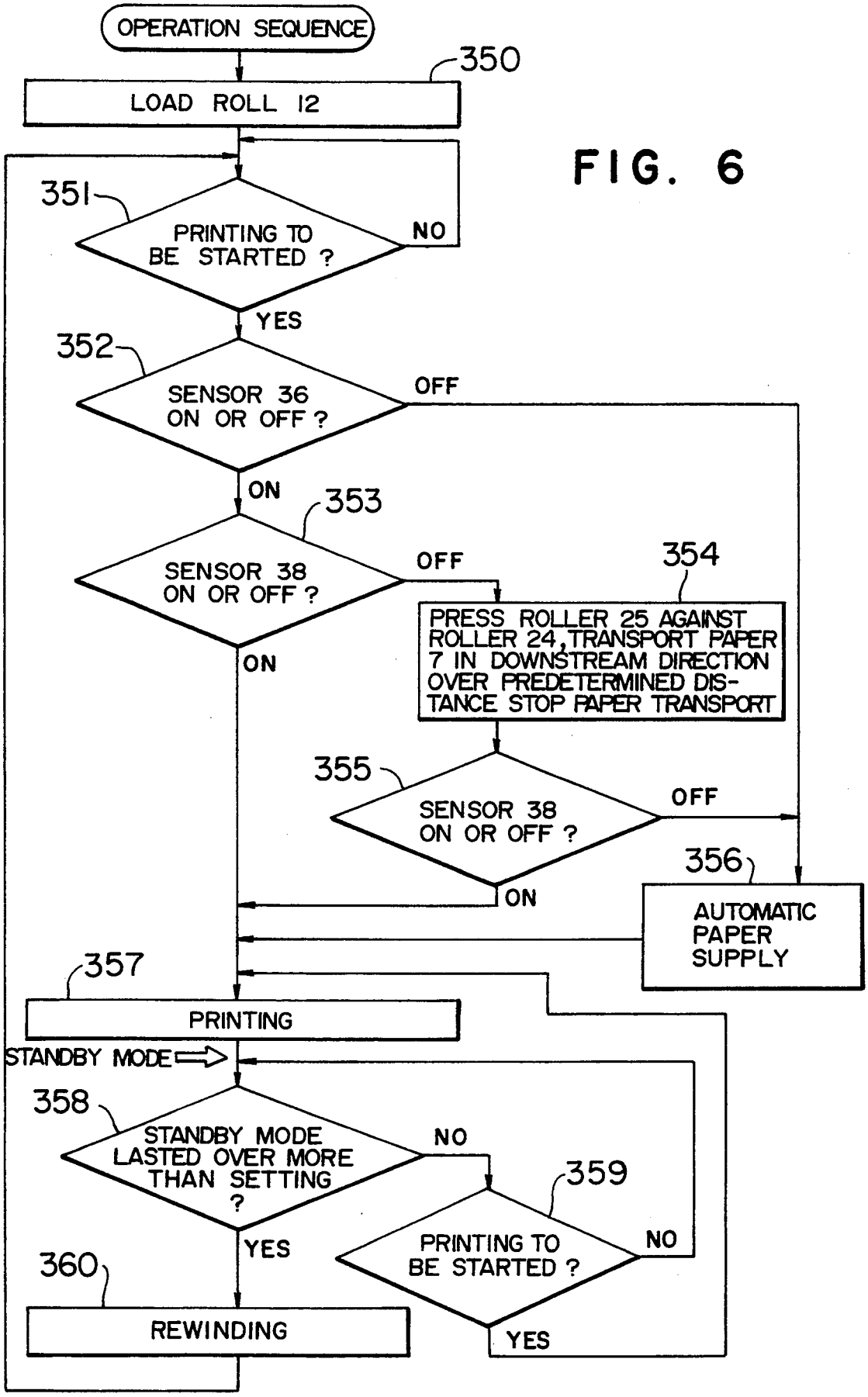
FIG. 6 is a general flow chart showing the sequence of steps of operation of the thermal printer shown in FIG. 1.

First, the operation sequence of the first embodiment, which is shown in FIG. 6, will be described with reference to FIGS. 9 to 13. In regard to the direction of transporting the printing paper 7, the direction of supplying the printing paper 7 from the printing paper roll 12 is called herein a downstream direction, while the direction of taking up or rewinding the printing paper 7 on the printing paper roll 12 is called herein an upstream direction. When the printing paper 7 is transported in the upstream direction, the transporting force is imparted to-the printing paper 7 from the paper transport roller 24 or from the combination of the front paper feed roller 15*a* and the rear paper feed roller 16*a*. In this case, the printing paper roll 12 is driven to take up the printing paper 7, so that the printing paper 7 may not slacken in the printing paper feed block 1 or between the printing paper feed block 1 and the printing paper roll 12. First, the printing paper roll 12 is manually loaded in the printing system 311 while holding the head block 3 in the position raised by the coil spring 43. In this case, the leading and 7*a* of the printing paper 7 is located at a position between the pair of the front paper feed rollers 15*a*, 15*b* and the pair of the rear paper feed rollers 16*a*, 16*b*. For example, the leading end 7*a* of the printing paper 7 is located at a position A in FIG. 9. For this purpose, an auxiliary roller vertically movable toward and away from the center of the printing paper roll 12, and its guide may be provided as shown in FIG. 35, and the auxiliary roller 411 brought into contact with the printing paper roll 12 may be driven so as to locate the leading end 7*a* of the printing paper 7 at the position A between the pair of the front paper feed rollers 15*a*, 15*b* and the pair of the rear paper feed rollers 16*a*, 16*b*. Then, the raised head block 3 is lowered to place the printing system 311 in the standby mode ready for printing operation. The manipulation described above corresponds to the step 350 shown in FIG. 6. At this time, the front paper feed rollers 15*a* and 15*b* are not in pressure contact with each other, while the rear paper feed rollers 16*a* and 16*b* are in pressure contact with each other. Under the above state, the printing system 311 waits for application of a printing command signal as its input. In the step 351 in FIG. 6, the printing operation is started as soon as the printing command signal is transferred to the system control circuit 314 from the data bus 327 or from the input switch 22. In the steps 352 and 353, the photo sensors 36 and 38 sense the presence or absence of the printing paper 7. When the results of sensing by the photo sensor 36 proves that the printing paper 7 is not present, that is, when the photo sensor 36 is in its off state, the step 352 is followed by the step 356 for automatically supplying the printing paper 7. The automatic supply step 356 is followed by the printing step 357. When both the photo sensors 36 and 38 are in their ON state, that is, when the presence of the printing paper 7 is sensed, the step 353 is immediately followed by the printing step 357.

On the other hand, when the photo sensor 38 is in its OFF state while the photo sensor 36 is in its on state, the step 353 is followed by the step 354 in which the pressure applying roller 25 is pressed against the paper transport roller 24 so as to drive the paper transport roller 24, thereby transporting the printing paper 7 over a predetermined distance of, for example, 3 cm in the downstream direction, and the transport of the printing paper 7 in the downstream direction is stopped. In the step 355, whether the photo sensor 38 is in its ON state or OFF state is detected. When the photo sensor 38 is in its on state, the printing step 357 is followed, while when the photo sensor 38 remains in its off state, the automatic paper supply step 356 is followed.

Figure 10:
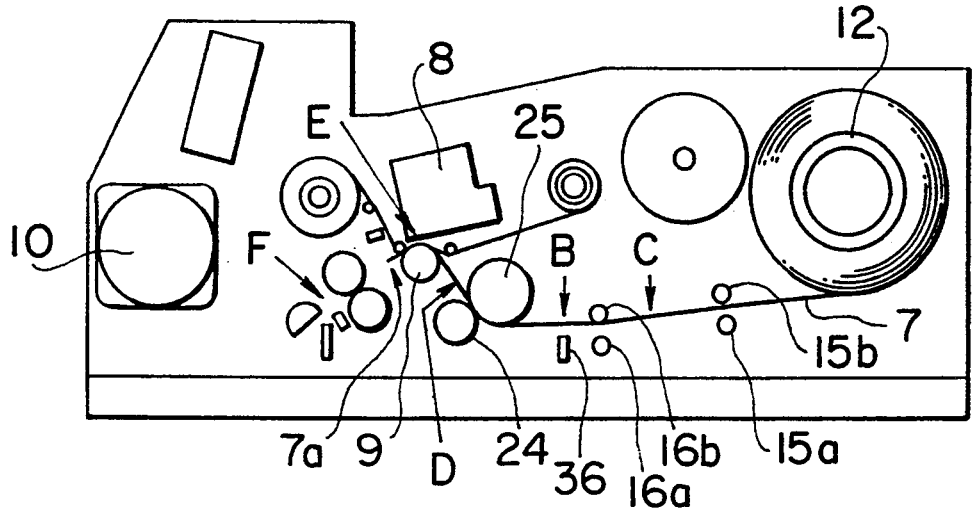
Figure 11:
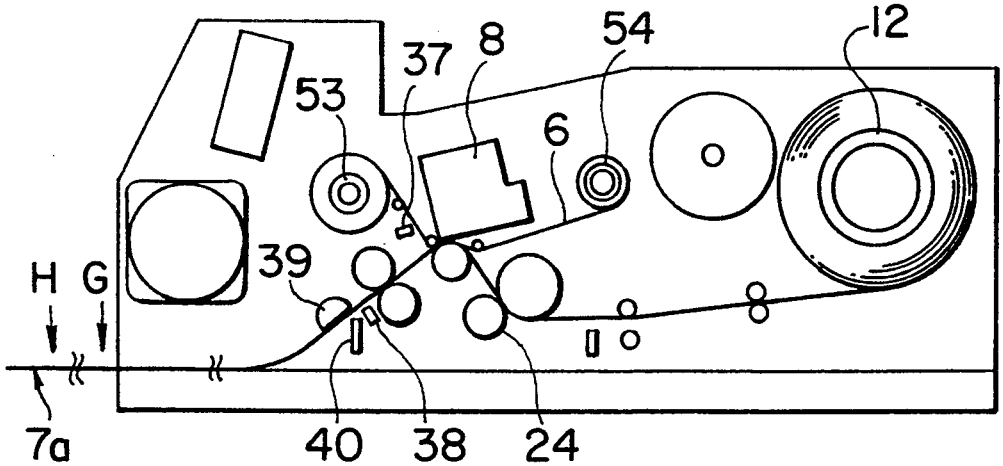
Figure 12:
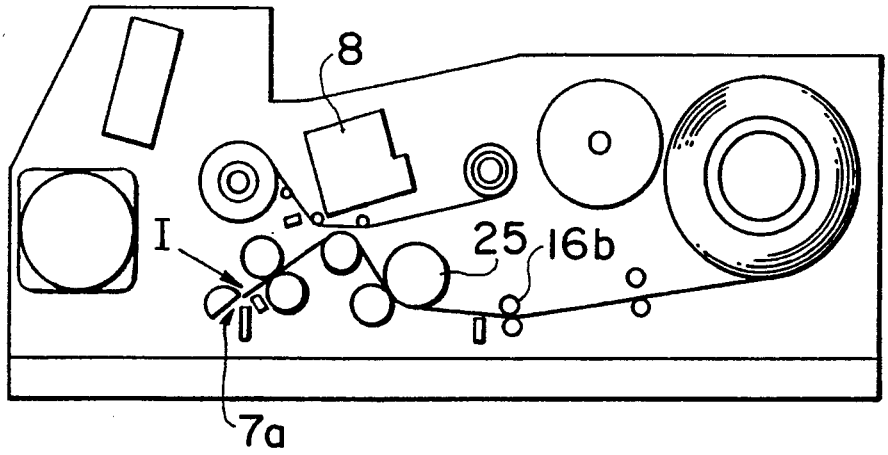

The automatic paper supply step 356 and the printing step 357 will be described in detail later with reference to FIGS. 10 and 11. FIG. 12 shows the state of the printing system 311 after the printing step 357 is ended, and it will be seen that the leading end 7*a* of the printing paper 7 is now located at a position I. Under this state, the printing system 311 waits for application of the next printing command signal as its input. In the state shown in FIG. 12, the printing paper 7 is firmly held at about its leading end *7a* between the delivery roller pair 27, 28, and a restraining force tending to cause curling of the printing paper 7 by the curvature of the platen roller 9 is imparted to the printing paper 7. Such a state is called herein the standby mode. FIG. 12 shows an example of this standby mode.

A timer is provided in the program stored in the ROM 324 shown in FIG. 2, and a predetermined period of time of, for example, 5 min. is set in the timer. In the step 358 shown in FIG. 6, the timer starts to operate as soon as the standby mode takes place so as to continuously check whether or not the standby mode lasts over more than the predetermined period of time. When the result of checking proves that the duration of the standby mode does not exceed the predetermined period of time, the printing operation in response to the printing command signal can be started in the step 359. On the other hand, when the result of checking proves that the duration of the standby mode exceeds the predetermined period of time, the printing paper 7 is rewound in the step 360. This rewinding step 360 will be described in detail later with reference to FIG. 13. The rewinding step 360 is followed by the step 351 again in which the printing system 311 waits for application of the next printing command signal as its input. The operation in the steps following the step 351 is the same as that described above.

The automatic paper supply mode in the step 356 in FIG. 6 will now be described in detail with reference to FIG. 10. This automatic paper supply mode takes place when both the photo sensors 36 and 38 are in their OFF state or when the photo sensor 36 is in its OFF state while the photo sensor 38 is in its ON state. In the latter case where the photo sensor 36 is in its OFF state while the photo sensor 38 is in its ON state, the front paper feed roller 15*a* and the rear paper feed roller 16*a* are driven to transport the printing paper 7 in the upstream direction until the leading end *7a* of the printing paper 7 passes the position of the photo sensor 36. The transport of the printing paper 7 in the upstream direction is stopped as soon as the photo sensor 36 is turned into its off state from its on state. However, this operation does not take place when both the photo sensors 36 and 38 are in their off state.

Then, the front paper feed roller 15*a* and the rear paper feed roller 16*a* are driven so as to transport the printing paper 7 in the downstream direction. The transport of the printing paper 7 in the downstream direction is stopped as soon as the photo sensor 36 is turned into its ON state from its OFF state. The leading end *7a* of the printing paper 7 is now located at a position B in FIG. 10. The transport of the printing paper 7 in the upstream direction is continued and stopped when the leading end *7a* of the printing paper 7 is located now at a position between the pair of the front paper feed rollers 15*a*, 15*b* and the pair of the rear paper feed rollers 16*a*, 16*b*. In this case, the front paper feed roller 15*b* may be or may not be pressed against the front paper feed roller 15*a*, and the force transporting the printing paper 7 is provided by the drive force driving the printing paper roll 12. Thus, the printing paper 7 supplied from the printing paper roll 12 is being rewound on the printing paper roll 12. At this time, the leading end *7a* of the printing paper 7 is located at, for example, a position C in FIG. 10.

Then, while bringing the front paper feed roller 15*b* into pressure contact with the front paper feed roller 15*a*, the printing paper 7 is transported in the downstream direction, and the transport of the printing paper 7 in the downstream direction is stopped when the leading end *7a* of the printing paper 7 is located at, for example, a position D between the platen roller 9 and the paper transport roller 24. Then, the cam 18 is rotated to bring the pressure applying roller 25 into pressure contact with the paper transport roller 24 and to move the front and rear paper feed rollers 15*b* and 16*b* away from the front and rear paper feed rollers 15*a* and 16*a* respectively. The paper transport roller 24 is then driven so as to transport the printing paper 7, and the transport of the printing paper 7 is stopped as soon as the leading end *7a* of the printing paper 7 passes a position E corresponding to the apex of the platen roller 9. The cam 18 is further rotated so as to press the thermal head 8 against the platen roller 9. Under the above state, the paper transport roller 24 is driven so as to transport the printing paper 7 in the downstream direction by the combined transporting force of the paper transport roller 24 and the platen roller 9. The transport of the printing paper 7 is stopped when its leading end *7a* is advanced to a position between the pair of the delivery roller 27 and the pressure applying roller 28, that is, in the gap between the delivery roller pair 27 and 28. The cam 18 is further rotated so as to move the thermal head 8 away from the platen roller 9 and to drive the paper transport roller 24 again. By the combined transporting force of the paper transport roller 24 and the delivery roller pair 27, 28, the printing paper 7 is transported in the downstream direction, and the transport of the printing paper 7 in the downstream direction is stopped as soon as its leading and *7a* reaches a position F where the photo sensor 38 is turned into its on state from its off state.

The printing operation in the step 357 in FIG. 6 will now be described in detail with reference to FIGS. 7 and 11.

Figure 7:
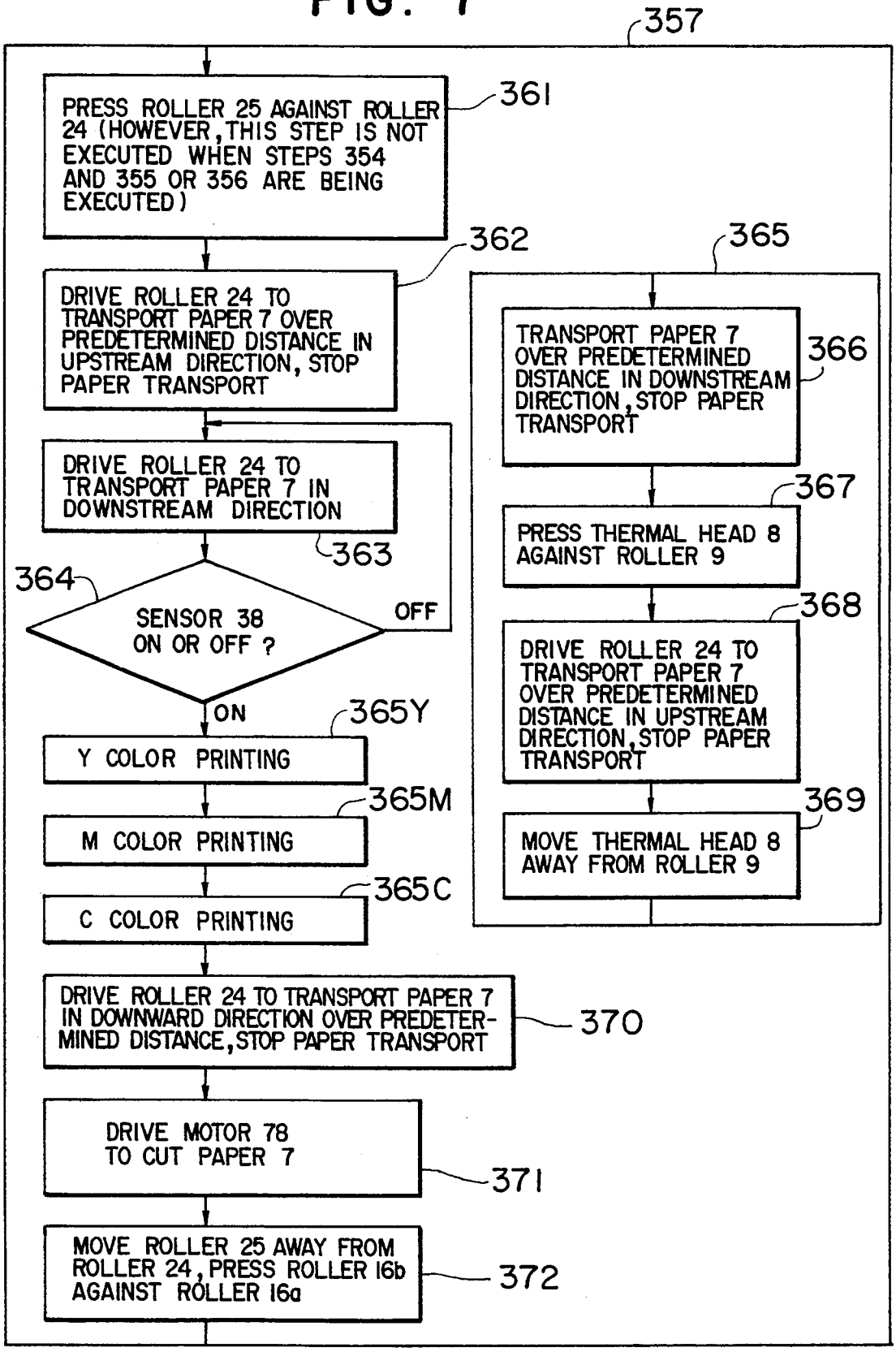
FIG. 7 is a flow chart showing details of the printing step shown in the flow chart of FIG. 6.

First, in the step 361 in FIG. 7, the cam 18 is rotated to press the pressure applying roller 25 against the paper transport roller 24. However, this operation is not executed when the steps 354 and 355 or 356 shown in FIG. 6 are being executed. Then, in the step 362, the paper transport roller 24 is driven to transport the printing paper 7 in the upstream direction over a predetermined distance of, for example, 2 cm, and the paper transport in the upstream direction is stopped. The purpose of this operation is to turn the photo sensor 38 into its OFF state from its ON state. When the photo sensor 36 is not turned into its OFF state as a result of the execution of the step 362, an error is displayed on the display 321. In such a case, the printing paper 7 must be manually reset. Then, in the step 363, the paper transport roller 24 is driven so as to transport the printing paper 7 in the downstream direction. In the step 364, the photo sensor 38 continuously senses the presence or absence of the printing paper 7. As soon as the photo sensor 38 is turned into its ON state from its OFF state, the step 365Y for Y color printing is executed.

The step 365 includes steps 366, 367, 368 and 369. In the step 366, the transport of the printing paper 7 in the downstream direction is stopped after the printing paper 7 is transported over a predetermined distance in the downstream direction. At this time, the leading end *7a* of the printing paper 7 is located at a position G in FIG. 11. When the printing is to be made on a piece of the printing paper 7 of the size A4, the predetermined distance described above designated the longitudinal dimension of the piece of the printing paper 7 of the size A4 corresponding to the distance between the position G and the position where the platen roller 9 makes pressure contact with the heat-generating resistor elements of the thermal head 8. The operation executed in the step 366 will be referred to hereinafter as delivery operation. In parallel with this delivery operation, both the ink-sheet supply roll 53 and the ink-sheet take-up roll 54 are driven so as to transport the ink sheet 6 in the upstream direction, and after the ink sensor 37 senses the position of the first color that is, the Y color on the ink sheet 6, both the ink-sheet supply roll 53 and the ink-sheet take-up roll 54 are stopped. The speed of transporting the ink sheet 6 is determined by the diameter of the ink-sheet supply roll 53. Therefore, when the ink sheet 6 wound around the ink-sheet supply roll 53 is successively supplied to decrease the length of the unused portion of the ink sheet 6, the diameter of the ink-sheet supply roll 53 is correspondingly decreased, with the result that the speed of transporting the ink sheet 6 is gradually slowed down. Therefore, means (not shown) for continuously detecting the diameter of the ink-sheet supply roll 53 is preferably provided so as to control the rotation speed of the supply motor 81 according to the detected diameter of the ink-sheet supply roll 53, thereby maintaining constant the speed of transporting the ink sheet 6.

Then, in the step 367, the thermal head 8 is pressed against the platen roller 9 through the ink sheet 6 and the printing paper 7 interposed therebetween. Then, in the step 368, the paper transport roller 24 is driven so as to transport the printing paper 7 in the upstream direction. The ink sheet 6 is also transported together with the printing paper 7 due to the friction between the ink sheet 6 and the printing paper 7. At the same time, the Y color, which is the first color, is transfer-printed on the printing paper 7 by the thermal head 8. At this time, the ink-sheet supply roll 53 is not driven and is merely slipping due to the function of the friction clutch 87, and the ink-sheet take-up roll 54 only is driven to take up the ink sheet 6 while also slipping due to the function of the friction clutch 88. Also, the delivery roller pair 27, 28 and the platen roller 9 are under follower rotation due to the frictional force acting between them and the printing paper 7. Especially, the paper delivery roller 27 acts to pull the printing paper 7 in the downstream direction due to the function of the friction clutch 74, so that the printing paper 7 can be transported in the downstream direction without slackening in the neighborhood of the platen roller 9. After the Y color is transfer-printed on the printing paper 7, the driving of the paper transport roller 24 and the ink-sheet take-up roll 54 is stopped in the step 368. Then, in the step 369, the cam 18 is rotated to move the thermal head 8 away from the platen roller 9, thereby ending the Y-color printing step 365Y.

The M-color printing step 365M and the C-color printing step 365C are then executed. Each of these steps 365M and 365C includes the steps 366, 367, 368, and 369 described above. After the C-color printing step 365C, the step 370 is executed in which the printing paper 7 is transformed in the downstream direction until its leading end 7*a* is located at a position H in FIG. 11. The distance between the position H and the position where the printing paper 7 is cut by the combination of the rotary knife 39 and the stationary knife 40 in the cutter block 4 in FIG. 11 corresponding to the longitudinal dimension of a paper of the size A4. Then, in the step 371, the rotary knife 39 is rotated to cut the printing paper 7 into a piece of the size A4. Then, in the step 372, the cam 18 is rotated to separate the paper transport roller 24 from the pressure applying roller 25 and to press the rear paper feed roller 16*b* against the rear paper feed roller 16*a*, thereby ending the printing operation and placing the printing system 311 in the standby mode shown in FIG. 12. In this standby mode, the leading end 7*a* of the printing.

Figure 14:
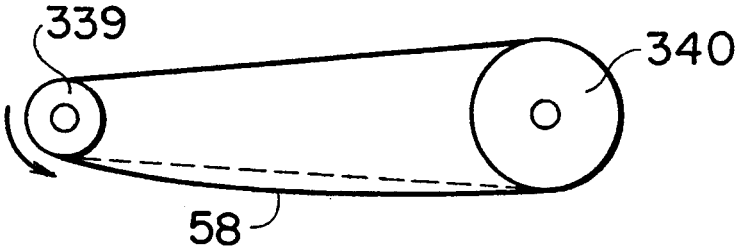
FIGS. 14 and 15 are schematic views illustrating tensional states of a timing belt during transfer of the printing paper.
Figure 15:
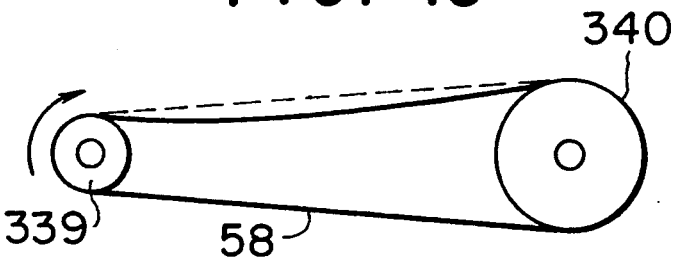

FIGS. 14 and 15 show different tensioned states. In FIG. 14, the reference numeral 339 designates a motor-side pulley mounted on the shaft of the main motor 10, and 340 designates a motor-side pulley mounted on the shaft of the paper transport roller 24. FIG. 14 illustrates the state of the timing belt 58 when the printing paper 7 is being transported in the downstream direction, and it will be seen that the lower run of the timing held 58 is slackened. On the other hand, FIG. 15 illustrates the state of the timing belt 58 when the printing paper 7 is being transported in the upstream direction, and it will be seen that the upper run of the timing belt 58 is slackened. In the printing operation, the transport of the printing paper 7 in the downstream direction for delivery purpose and the transport of the printing paper 7 in the upstream direction for printing purpose are repeated three times. That is, before printing of each of the Y color, the M color and the C color, the printing paper 7 is transported in the direction opposite to the direction of transport for the purpose of printing. Therefore, in the print mode according to the present invention, slackening occurs necessarily on the lower run of the timing belt 58 before printing of any one of the Y, M and C colors, on the printing paper 7.

Figure 13:
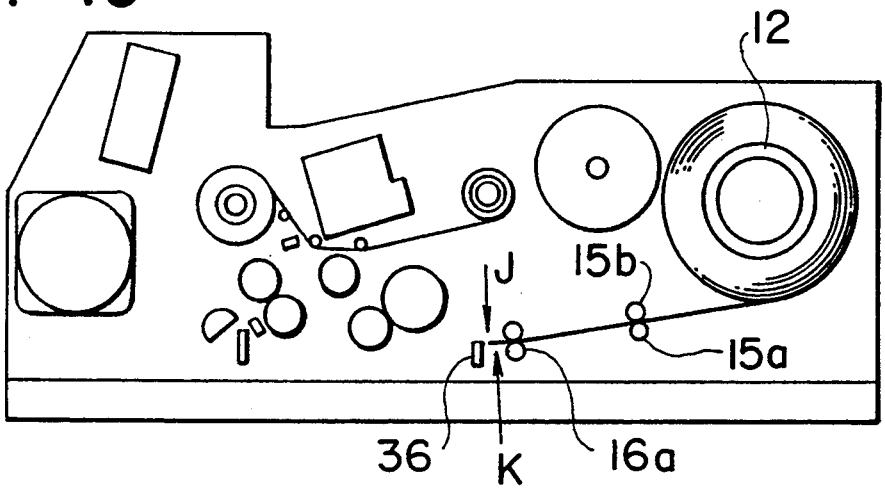

The rewinding operation in the step 360 shown in FIG. 6 will now be described with reference to FIGS. 8 and 13.

Figure 8:
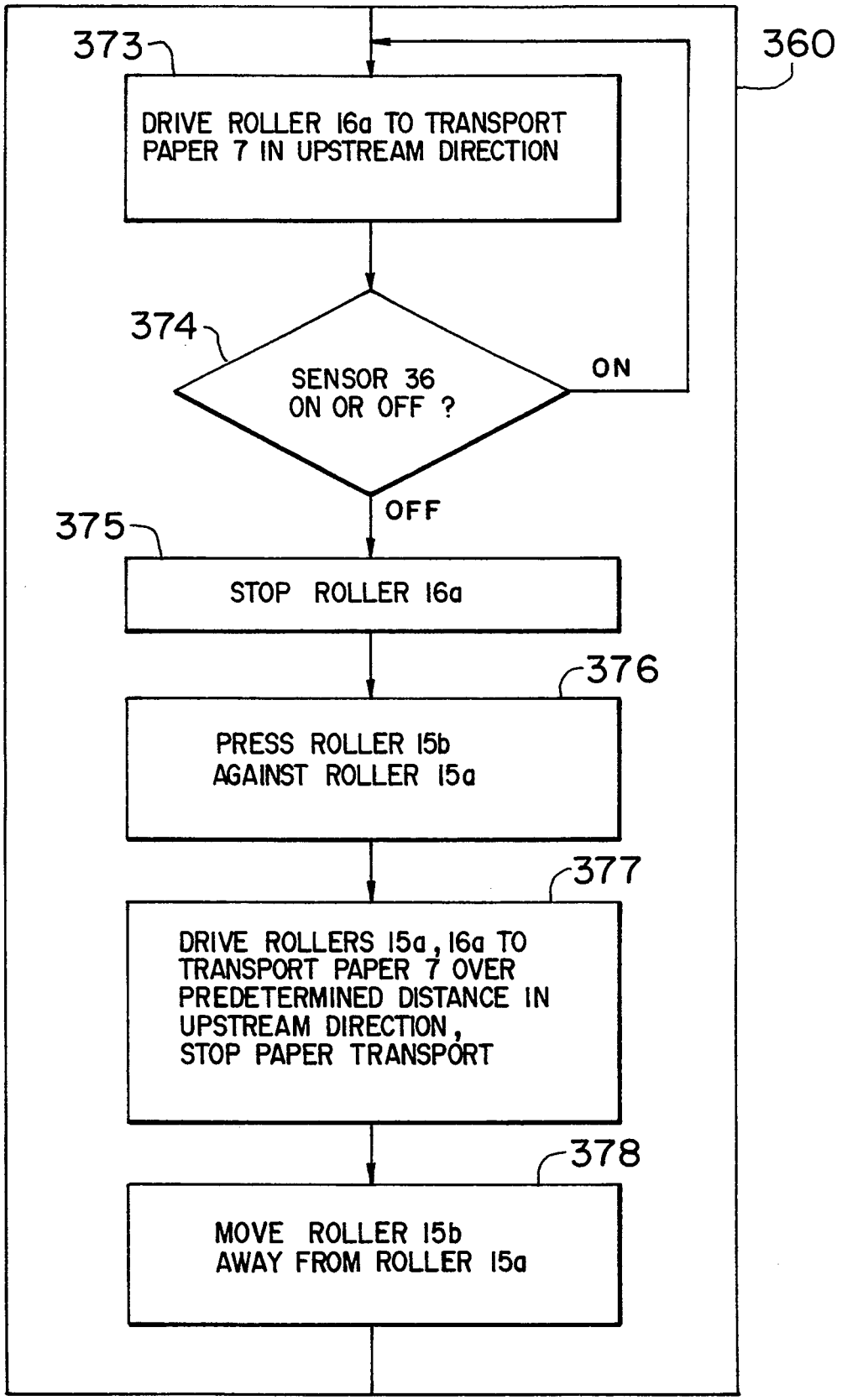
FIG. 8 is a flow chart showing details of a rewinding step in the flow chart shown in FIG. 6.
Figure 9:
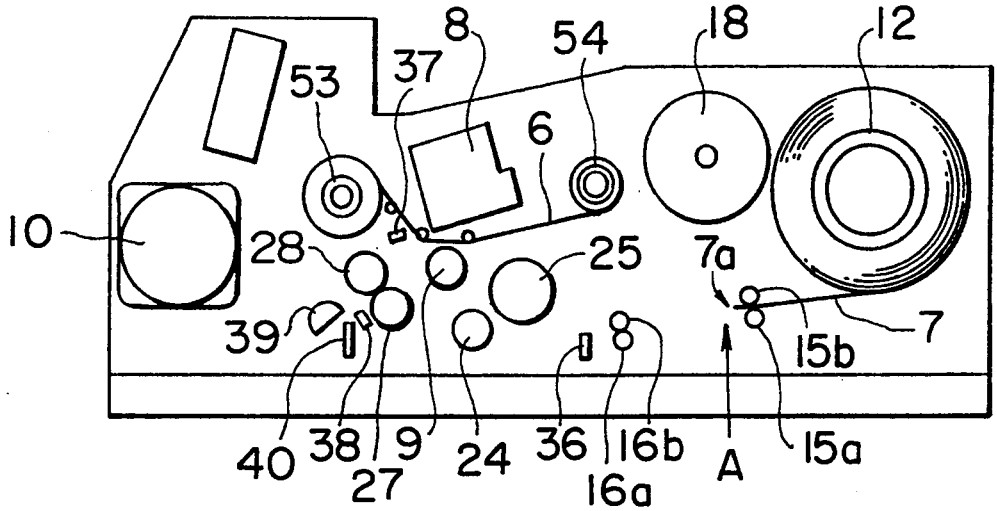
FIGS. 9–13 are schematic views respectively illustrating the operation of the printing system and various positions of the leading end of the printing paper in the printing system.

First, in the step 373 in FIG. 8, the rear paper feed roller 16*a* is driven so as to transport the printing paper 7 in the upstream direction. In the next step 374, the photo sensor 36 continuously senses the presence or absence of the printing paper 7. As soon as the photo sensor 36 is turned into its OFF state from its ON state, the driving of the rear paper feed roller 16*a* is stopped in the step 375. At this time, the leading end 7*a* of the printing paper 7 is located at a position J in FIG. 13. Then, in the step 376, the front paper feed roller 15*b* is urged downward to make pressure contact with the front paper feed roller 15*a*. Then, in the step 377, both the front paper feed roller 15*a* and the rear paper feed roller a are driven so as to transport the printing paper 7 in the upstream direction again, and the transport of the printing paper 7 in the upstream direction is stopped as soon as the leading end 7*a* of the printing paper 7 reaches a position where the leading end 7*a* does not pass through the gap between the rear paper feed rollers 16*a* and 16*b*. At this time, the leading end 7*a* of the printing paper 7 is located at, for example, a position K in FIG. 13. Then, in the step 378, the front paper feed roller 15*b* is moved away from the front paper feed roller 15*a*, thereby ending the rewinding operation. Thus, the restraining force acting on the printing paper 7 in the standby mode can be released.

The first embodiment of the present invention provides various notable advantages which will now be described.

In the first place, the rewinding operation takes place as soon as the duration of the standby mode exceeds a predetermined period of time, so that occurrence of an undesirable curling on the printing paper 7 can be reliably prevented.

Secondly, the state of slackening of the upper or lower run of the timing belt 58 immediately before starting the printing operation is selected to be the same for all of the Y, M and C colors, so that all of these colors can be printed over the same length on the printing paper 7, and undesirable color misalignment attributable to different stated of slackening of the timing belt 58 can be entirely prevented.

Thirdly, the hardness of the particulate material bonded to the surface of the paper transport roller 24 is selected to be lower than that of the surface of the heat-generating resistor elements of the thermal bead 8, so that undesirable damage to the thermal head 8 due to strip-off of the particulate material from the surface of the roller 24 can be prevented. Further, by suitably selecting the particulate material, the out-of-roundness as well as the cylindricality of the paper transport roller 24 can be improved.

Fourthly, the force imparted from the pressure applying roller 25 to the paper transport roller 24 is selected to be lower than a predetermined limit, so that appearance of stripe-like color nonuniformity in the widthwise direction of printed images can be reliability prevented.

Fifthly, the pressure applying roller 25 is in the form of a single cylindrical roller having a smooth surface having no stepped portions, grooves, etc. Therefore, appearance of color nonuniformity on printed images due to local changes in the force imparted to the printing paper 7 can be prevented.

Figure 16:
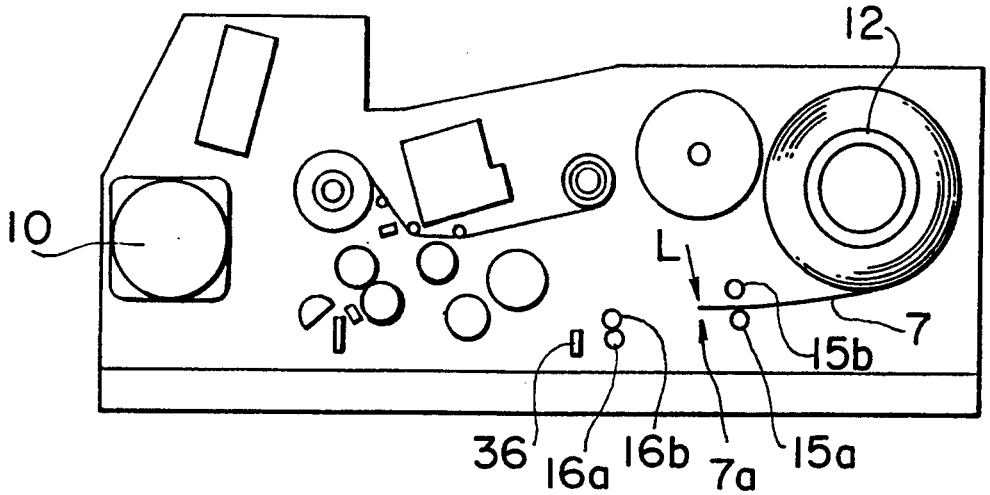
FIGS. 16–18 are diagrammatic views depicting various positions of the leading end of the printing paper in a printing system constructed in accordance with another embodiment of present invention.
Figure 17:
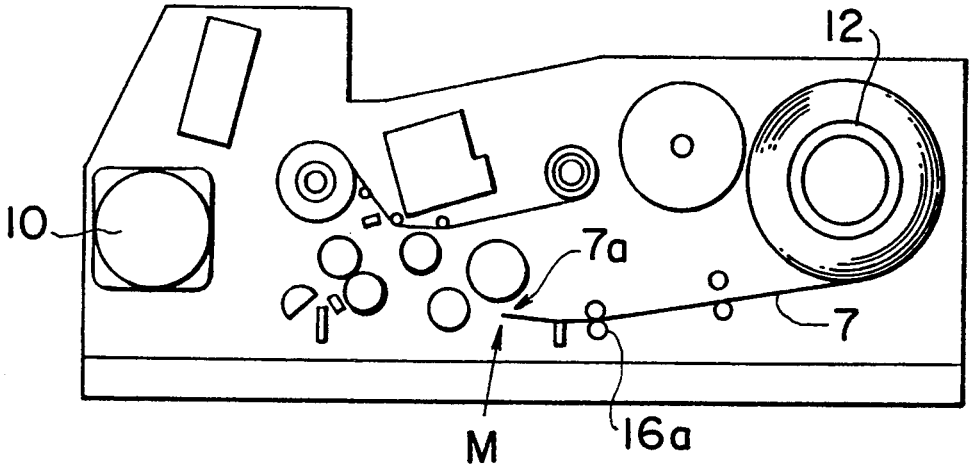
Figure 18:
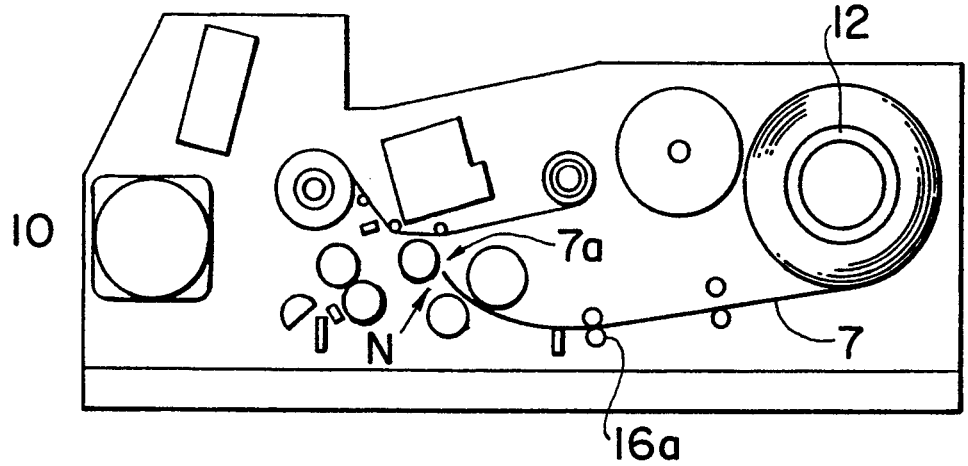

A second embodiment of the present invention shown in FIGS. 16 to 18. This second embodiment is a partial modification of the first embodiment in that the position of the leading end *7a* of the printing paper 7 at the end of the rewinding operation differs from that in the first embodiment.

FIG. 16 illustrates the case where the leading end *7a* of the printing paper 7 is located at, for example, a position L between the front paper feed roller pair 15*a*, 15*b* and the rear paper feed roller pair 16*a*, 16*b*. FIG. 17 illustrates the case where the leading end *7a* of the printing end *7a* of the printing paper 7 is located at, for example, a position M between the paper transport roller 24 and the photo sensor 36. FIG. 18 illustrates the case where the leading end *7a* of printing paper 7 is located at, for example, a position N between the platen roller 9 and the paper transport roller 24.

It will be seen that, in each of the above cases, the leading end *7a* of the printing paper 7 is located on the side of the printing paper roll 12 relative to the platen roller 9. Therefore, when compared to the standby mode, the paper restraining force acting on the printing paper 7 is very small or can be substantially released, so that undesirable curling of the printing paper 7 can be prevented as in the case of the first embodiment.

A third embodiment of the present invention shown in FIGS. 19 to 22. is also a partial modification of the first embodiment in that the pressure applying roller 25 is replaced by the heat roller 25' so as to forcedly remedy or correct curling of the printing paper 7 immediately before the printing operation is started.

Figure 19:
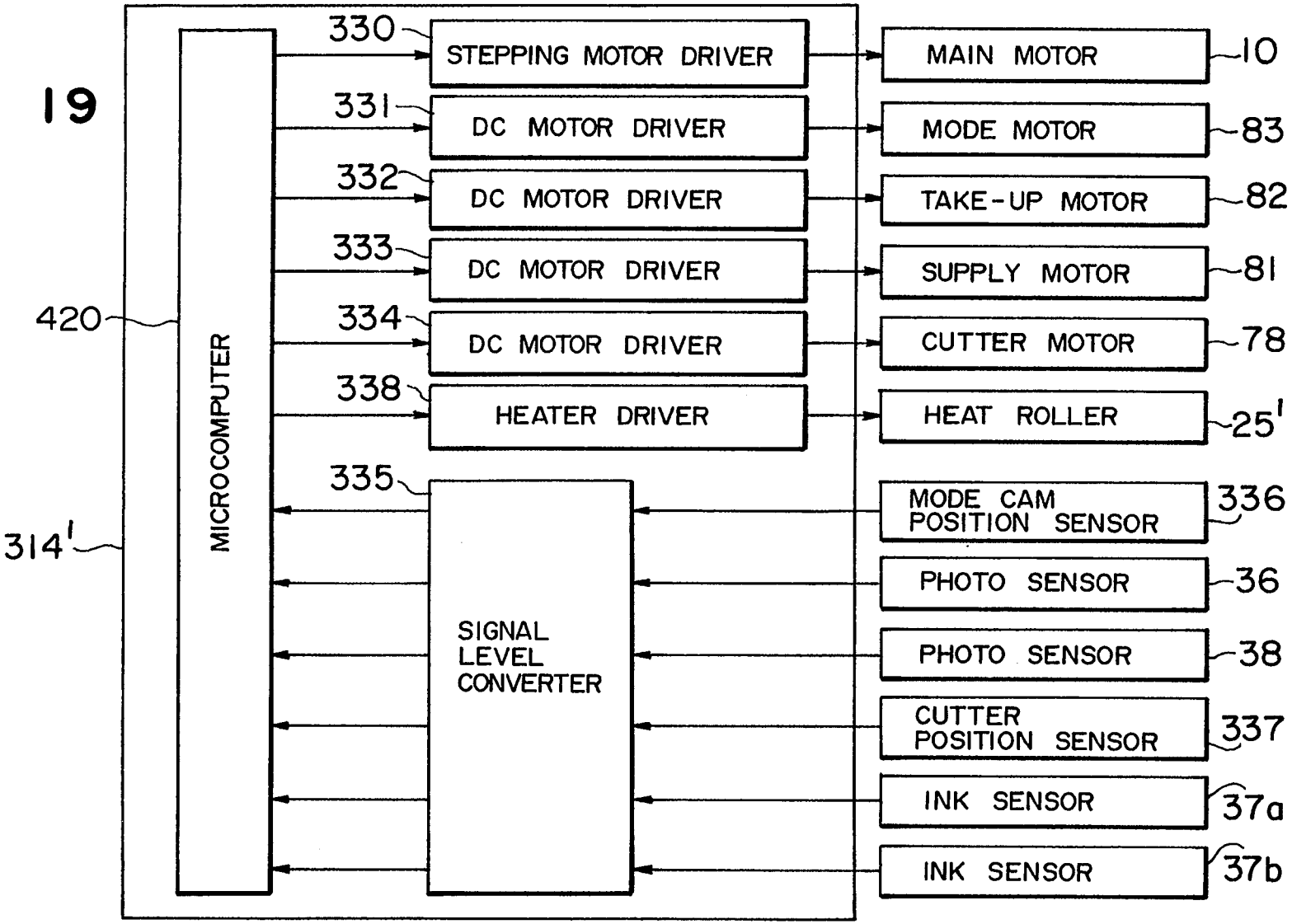
FIG. 19 is a block diagram of a system control circuit constructed in accordance with yet a further embodiment of the present invention.

FIG. 19 shows the structure of a system control circuit 314' incorporated in the third embodiment. In this system control circuit 314', a heater drive circuit 338 is provided so as to heat the heat roller 25' by heating means (not shown) built in the heat roller 25'. The remaining circuits and parts are the same as those employed in the first and second embodiments described above.

Figure 20:
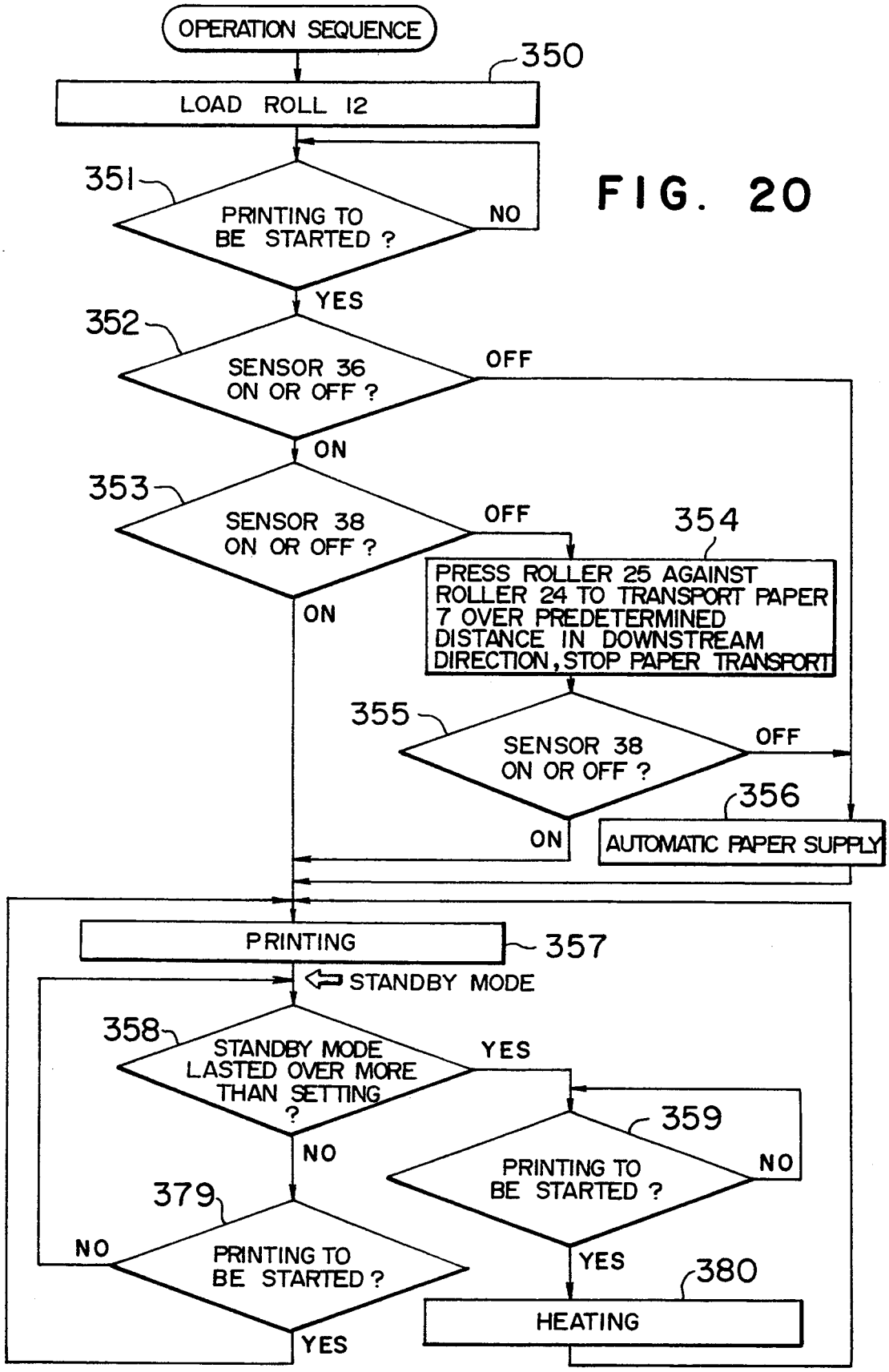
FIG. 20 is a general flow chart showing a sequence of steps of operation of the thermal printer.
Figure 21:
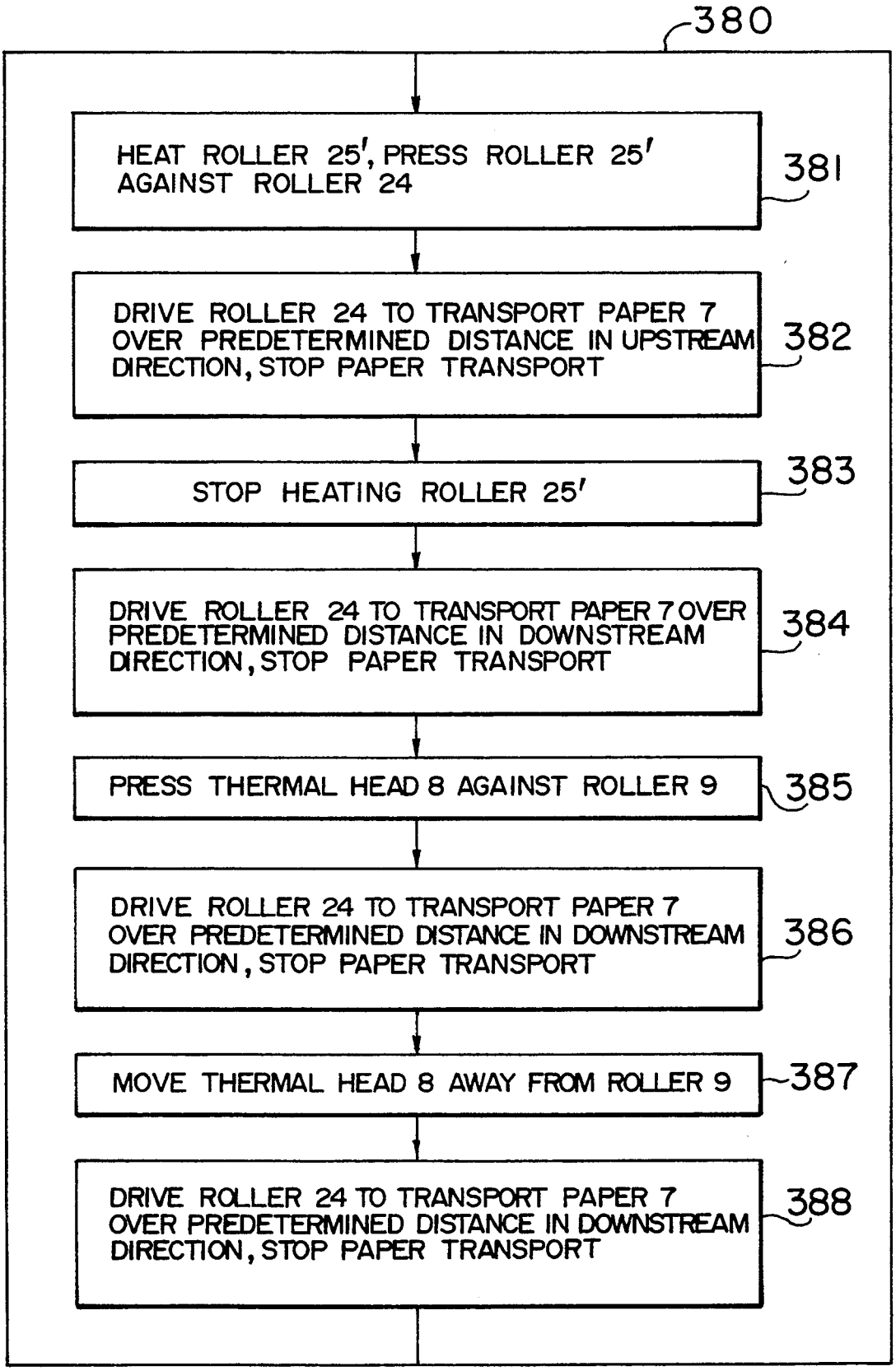
FIG. 21 is a flow chart showing details of a heating step in the flow chart shown in FIG. 20.
Figure 22:
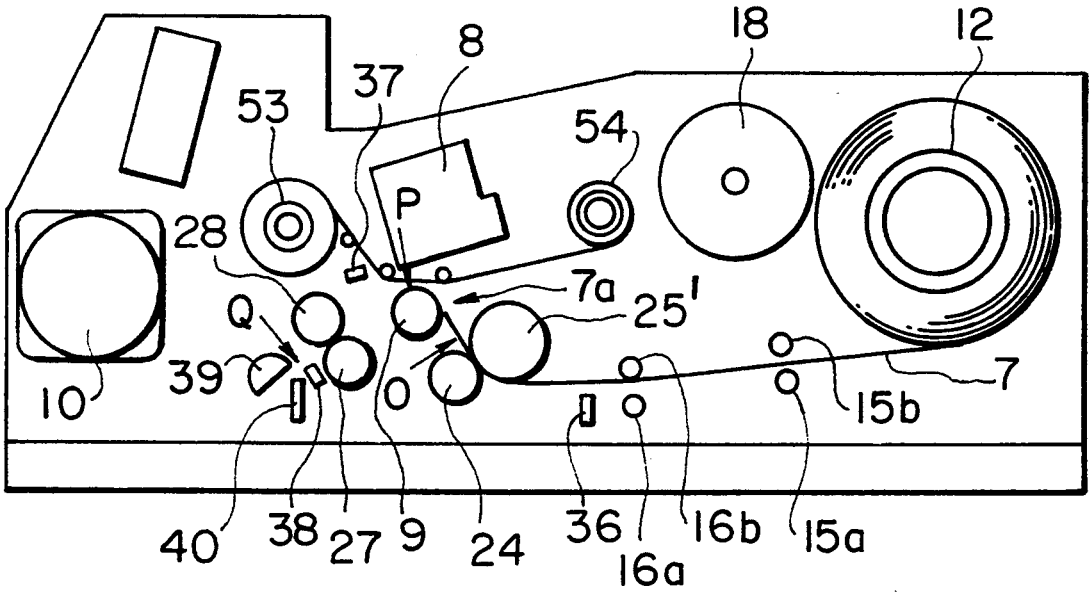
FIG. 22 is a schematic view depicted in the operation of the printing system and various positions of the leading end of the printing paper in the printing system.

The operation of the third embodiment will now be described with reference to FIGS. 20 to 22. In the flow chart shown in FIG. 20, the steps 350 to 358 are the same as those in the first and second embodiments, and the printing operation can be started as a result of the decision made in the step 379 when the duration of the standby mode does not exceed a predetermined period of time of, for example, 5 min. When the printing operation is to be started as a result of the decision made in the step 359 after the duration of the standby mode exceeds the predetermined period of time, the printing operation step 357 is executed after execution of a heating step 380.

This step 380 of heating operation will be described with reference to FIGS. 21 and 22. First, in the step 381 in FIG. 21, the heat roller 25' is heated and pressed against the paper transport roller 24, and the rear paper feed roller 16*b* is moved away from the rear paper feed roller 16*a*. In the step 382, the paper transport roller 24 is driven under the above condition so as to transport the printing paper 7 is the upstream direction over a predetermined distance while heating the printing paper 7 by the heat roller 25', and the transport of the printing paper 7 in the upstream direction is stopped. This step 382 is the correction step in which curling of the printing paper 7 is corrected. At this time, the leading end *7a* of the printing paper 7 is located at, for example, a position 0 in FIG. 22, and FIG. 15 shows the tensioned state of the timing belt 58 in the step 382. Then, in the step 383, the heating by the heat roller 25' is stopped. In the next step 384, the printing paper 7 is transported over a predetermined distance in the downstream direction, and the transport of the printing paper 7 in the downstream direction is stopped. At this time, the leading end *7a* of the printing paper 7 is located at, for example, a position P in FIG. 22. Then, in the step 385, the cam 18 is rotated to bring the thermal head 8 into pressure contact with the platen roller 9. Then, in the step 386, the paper transport roller 24 is driven so as to transport the printing paper 7 over a predetermined distance in the downstream direction, and the transport of the printing paper 7 in the downstream direction is stopped. This predetermined distance designates the distance over which the printing paper 7 is transported until its leading end *7a* is firmly held in the gap between the delivery roller pair 27, 28, and the photo sensor 38 is turned into its off state from its on state. In the next step 387, the thermal head 8 is moved away from the platen roller 9. Then, in the step 388, the paper transport roller 24 is driven again so as to transport the printing paper 7 over a predetermined distance in the downstream direction, and the transport of the printing paper 7 in the downstream direction is stopped. This predetermined distance designates the distance over which the printing paper 7 is transported until the photo sensor 38 is turned into its ON state from its OFF state. At this time, the leading end *7a* of the printing paper 7 is located at, for example, a position Q in FIG. 22. The step 388 ends the heating operation step 380 shown in FIG. 20.

A power transmission mechanism preferably used in a fourth embodiment of the present invention is shown 23. The power transmission mechanism shown in FIG.

23 is a modification of the power transmission mechanism used in the first embodiment for driving the paper transport roller 24.

Figure 23:
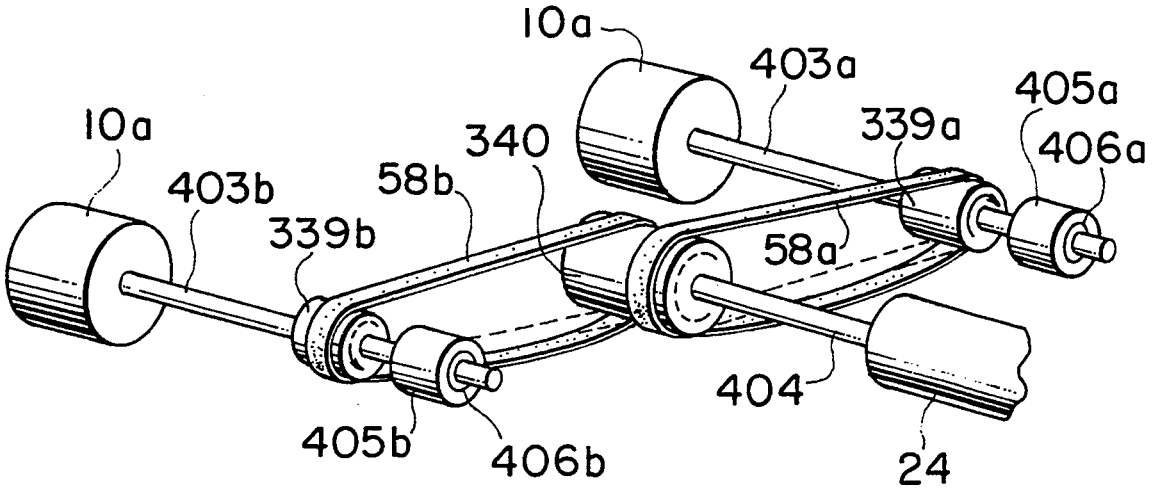
FIGS. 23 and 24 are perspective schematic views of alternate power transmission systems constructed in accordance with the present invention.

Referring to FIG. 23, the illustrated power transmission mechanism includes two timing belts 58*a* and 58*b*, two motor-side pulleys 339*a* and 339*b* fixed to the shafts 403*a* and 403*b* of two main motors 10*a* and 10*b* respectively, and a roller-side pulley 34*c* fixed to the shaft 404 of the paper transport roller 24. The main motors 10*a* and 10*b* rotate in directions opposite to each other so as to selectively transmit their drive power to the paper transport roller 24. When one of the two main motors, for example, the main motor 10*a* is rotating to drive the paper transport roller 24, the other main motor 10*b* is under follower rotation and the shaft 403*b* of the main motor 10*b* under follower rotation is imparted with a load from an associated torque limiter 405*b*.

The torque limiter 405*b* is non-rotatably fixed, and a one-way clutch 406*b* mounted on the main motor shaft 403*b* is in contact with the torque limiter 405*b*. When the main motor shaft 403*b* is under driving rotation, the one-way clutch 406 in contact with the torque limiter 405*b* is kept stationary and does not impart the load to the main motor shaft 403*b*. On the other hand, when the main motor 10*b* is under follower rotation, the one-way clutch 406*b* in contact with the torque limiter 405*b* rotates together with the main motor shaft 403*b* thereby imparting the load to the main motor shaft 403*b*. The arrangement of another torque limiter 405*a* and an associated one-way clutch 406*a* is similar to that of the torque limiter 405*b* and the one-way clutch 406*b*, and the combination acts in the same way on the main motor shaft 403*a*. The pulley ratio between the roller-side pulley 340 and the motor-side pulley 339 need not necessarily be the same as that between the roller-side pulley 340 and the motor-side pulley 339*b*.

The operation of the power transmission mechanism shown in FIG. 23 will now be described. One of the motor-side pulleys, for example, the motor-side pulley 39*a* driven by the main motor 10*a* rotates only in the direction shown by the solid arrow, while the motor-side pulley 339*b* driven by the main motor 10*b* rotates only in the direction shown by the broken arrow. When the motor-side pulley 339*a* is rotating in the direction of the solid arrow so as to transport the printing paper 7 in the upstream direction, the timing belt 58*a* is tensioned in its upper run and slackened in its lower run. At this time, the other motor-side pulley 339*b* is under follower rotation, and, due to the rotation of the roller-side pulley 340 in the same direction as that of the motor-side pulley 339*a*, the timing belt 58*b* is also tensioned in its upper run and slackened in its lower run.

On the other hand, when the motor-side pulley 339*b* is rotating in the direction of the broken arrow so as to transport the printing paper 7 in the downstream direction, the timing bolt 58*b* is tensioned in its upper run and slackened in its lower run as in the case of the transport of the printing paper 7 in the upstream direction. At this time, the other motor-side pulley 339*a* is under follower rotation and, due to the rotation of the roller-side pulley 340 in the same direction as that of the motor-side pulley 339*b*, the timing belt 58*a* is also tensioned in its upper run and slackened in its lower run as in the case of the transport of the printing paper 7 in the upstream direction.

As described above, in both the case of transporting the printing paper 7 in the upstream direction and the case of transporting the printing paper 7 in the downstream direction, the tensioned and slackened states of both the timing belts 58*a* and 58*b* do not appreciably change, so that the transported distance of the printing paper 7 in the upstream direction does not appreciably differ from the transported distance in the downstream direction.

Figure 24:
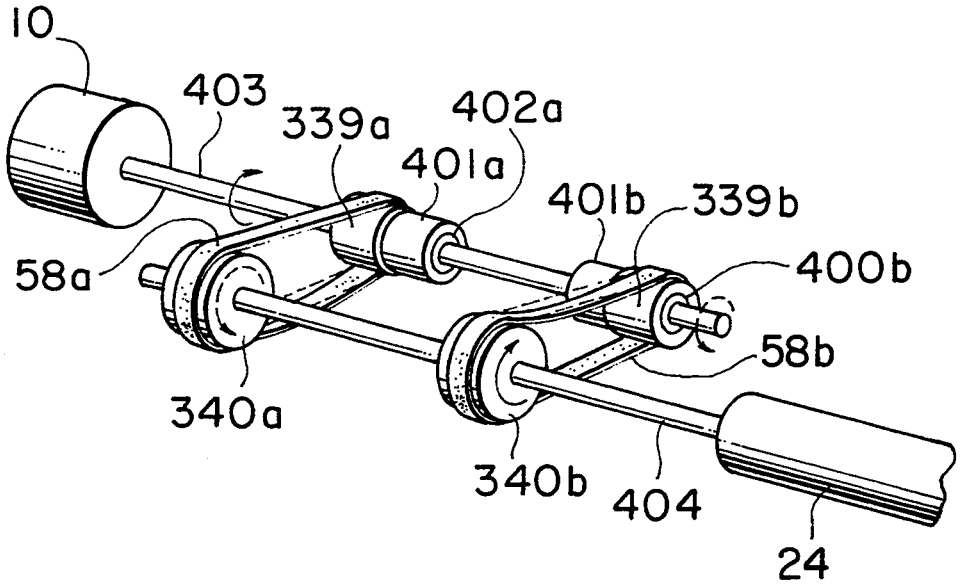
Figure 25:
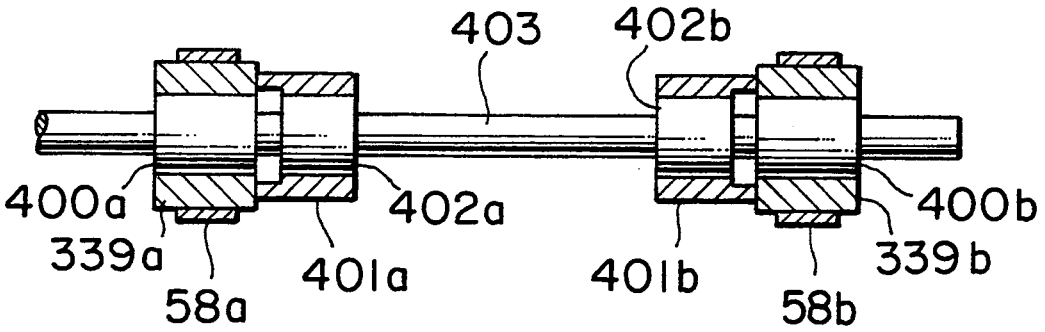
FIG. 25 is a cross-sectional view of a portion of the power transmission mechanism of FIG. 24.

A power transmission mechanism used in a fifth embodiment of the present invention is shown FIGS. 24 and 25. The power transmission mechanism shown in FIGS. 24 and 25 is also a modification of the power transmission mechanism used in the first embodiment, as in the case of that shown in FIG. 23.

Referring to FIG. 24, the power transmission mechanism includes two timing belts 58*a* and 58*b*, and two motor-side pulleys 339*a* and 339*b*, and two roller-side pulleys 340*a* and 340*b* mounted on the shaft 404 of the paper transport roller 24. FIG. 25 shows that two one-way clutches 400*a* and 400*b* are carried by the respective motor-side pulleys 339*a* and 339*b*. These one-way clutches 400*a* and 400*b* are associated with the main motor shaft 403 so as to transmit the drive power of the main motor 10 in directions opposite to each other respectively. The drive power of the main motor 10 is transmitted through these power transmission means to the paper transport roller 24 so as to cause rotation of the roller 24 in one direction and the other.

When one of the motor-side pulleys, for example, the motor-side pulley 339*a* is driven by the main motor 10, the other motor-side pulley 339*b* is under follower rotation and imparted with a load from an associated torque limiter 401*b*. The torque limiter 401*b* is mounted through a rolling bearing 402*b* on the motor shaft 403 and is normally in pressure contact with the motor-side pulley 339*b*. When the motor-side pulley 339*b* is driven by the main motor 10, the torque limiter 401*b* in contact with the motor-side pulley 339*b* rotates together with the motor-side pulley 339*b* without imparting the load to the motor side pulley 339*b*. On the other hand, when the motor-side pulley 339*b* is under follower rotation, the torque limiter 401*b* is held against rotation by fixing means (not shown) and imparts the load to the motor-side pulley 339*b*. Another torque limiter 401*a* similar to the torque limiter 401*b* is similarly associated with the other motor-side pulley 339*a*.

The combination of the power transmission means disposed nearer to the main motor 10, that is, the motor-side pulley 339*a*, the roller-side pulley 340*a* and the timing belt 58*a*, is referred to herein as a group a, and the combination of the power transmission means remote from the main motor 10, that is, the motor-side pulley 339*b*, the roller-side pulley 340*b* and the timing belt 58*b*, is referred to herein as a group b. It is apparent that the pulley ratio in the group b must be the same as that in the group b.

Although the paper transport roller 24 is shown disposed on the right-hand side of the roller-side pulley 340*b* as shown in FIG. 24, it may be disposed on the left-hand side of the roller-side pulley 340*a* or at a position intermediate between the roller-side pulleys 340*a* and 340*b*. Also, these two roller-side pulleys 340*a* and 340*b* may be combined into a single roller-side pulley, and the two timing belts 58*a* and 58*b* may be engaged with this single roller-side pulley.

In the power transmission mechanism of FIGS. 24 and 25. When the main motor 10 is rotating in the direction shown by the solid arrow so as to transport the printing paper 7 in the upstream direction, the drive power is transmitted through the one-way clutch 400*a* to the motor-side pulley 339*a*, while no drive power is transmitted through the one-way clutch 400*b* to the motor-side pulley 339*b*. The drive power is then transmitted from the motor side pulley 339*a* to the roller side pulley 340*a* by the timing belt 58*a*, and the paper transport roller 24 is driven to rotate in the direction of transporting the printing paper 7 in the upstream direction. Thus, in the group a, the motor-side pulley 339*a* operates as the driving pulley, and the timing belt 58*a* is tensioned in its lower run and slackened in its upper run as shown in FIG. 24. Also, the roller-side pulley 340*b* is driven by the rotation of the roller-side pulley 340*a* and acts to rotate the motor-side pulley 339*b* by the timing belt 58*b*. Thus, in the group b, the roller-side pulley 340*b* operates as the driving pulley, and the timing belt 58*b* is tensioned in its upper run and slackened in its lower run as shown.

On the other hand, when the main motor 10 is rotating in the direction shown by the broken arrow so as to transport the printing paper 7 in the downstream direction, the drive power is transmitted through the one-way clutch 400*b* to the motor-side pulley 339*b*, while no drive power is transmitted through the one-way clutch 400*a* to the motor-side pulley 339*a*. The drive power is then transmitted from the motor-side pulley 339*b* to the roller-side pulley 340*b* by the timing belt 58*b*, and the paper transport roller 24 is driven to rotate in the direction of transporting the printing paper 7 in the downstream direction. Thus, in the group b, the motor-side pulley 339*b* operates as the driving pulley, and the timing belt 58*b* is tensioned in its upper run and slackened in its lower run as in the case of the paper transport in the upstream direction. Also, the roller-side pulley 340*a* is driven by the rotation of the roller-side pulley 340*b* and acts to rotate the motor-side pulley 339*a* by the timing belt 58*a*. Thus, in the group a, the roller-side pulley 340*a* operates as the driving pulley, and the timing belt 58*a* is tensioned in its lower run and slackened in its upper run as in the case of the paper transport in the upstream direction.

It will be seen from the above description that the tensioned and slackened states of both the timing belts 58*a* and 58*b* do not appreciably change regardless of the direction of rotation of the main motor 10, so that the transported distance of the printing paper 7 in the upstream direction does not appreciably differ from the transported distance in the downstream direction.

Figure 26:
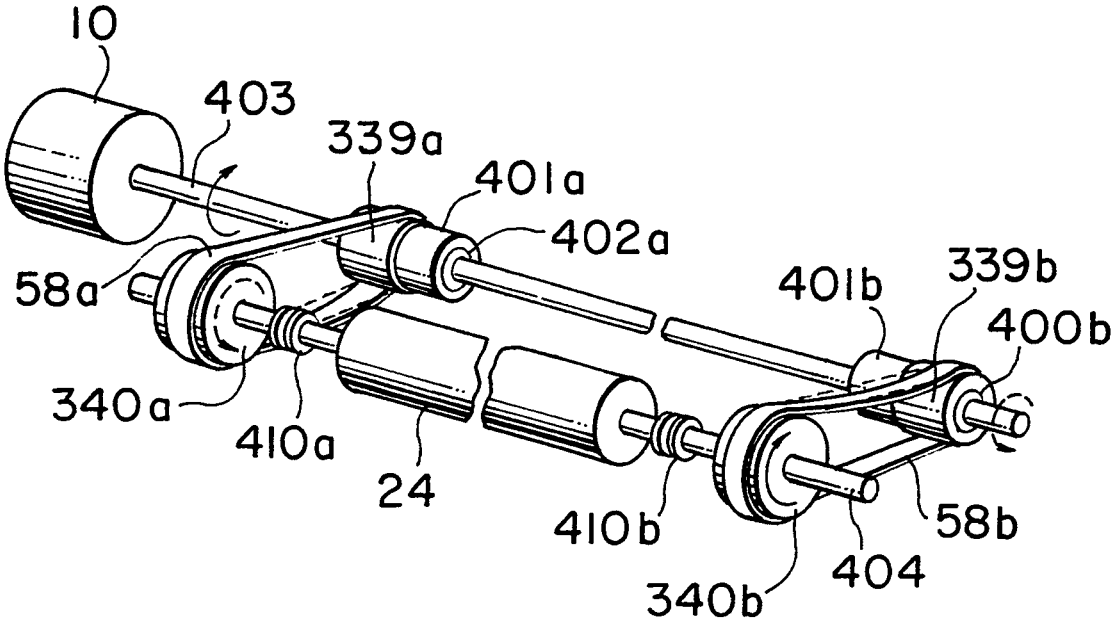
FIGS. 26 and 27 are schematic perspective views of further power transmission mechanisms constructed in accordance with the present invention.

A power transmission mechanism used in a sixth embodiment of the present invention is shown in FIG. 26. In FIG. 26, the paper transport roller 24 is disposed between the roller-side pulleys 340*a* and 340*b*, and two disengageable clutches 410*a* and 410*b* are mounted on the shaft of the paper transport roller 24 between the paper transport roller 24 and the two roller-side pulleys 340*a* and 340*b* respectively. One of these clutches 410*a* and 410*b* which is nearer to the motor-side pulley transmitting the drive power from the main motor 10 is engaged while the other is disengaged. Except the above difference in the arrangement, the structure and operation of the form shown in FIG. 26 are the same as those of the form shown in FIG. 24. In the power transmission mechanism shown in FIG. 26, the pulley ratio in the group b need not necessarily be the same as that in the group b. It will be seen from the description of the power transmission mechanism used in the sixth embodiment that the transported distance of the printing paper 7 in the upstream direction does not appreciably differ from that in the downstream direction, as in the case of the fourth and fifth embodiments described already.

Figure 27:
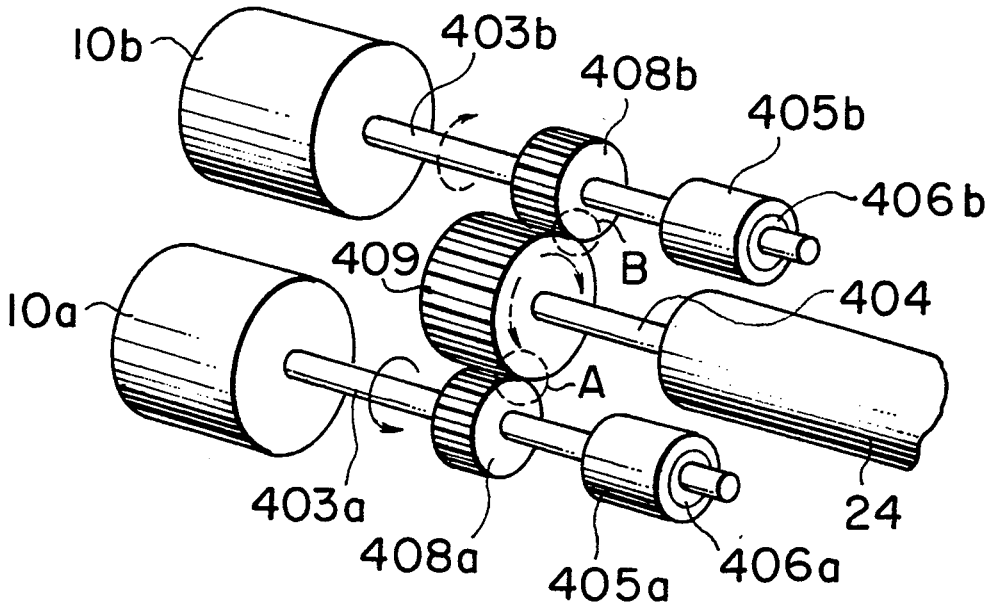
Figure 28:
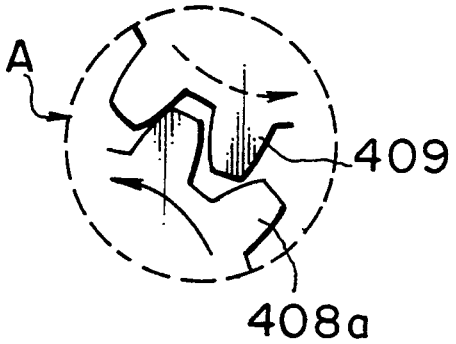
FIG. 28 is an enlarged detail view of the area designated A in FIG. 27.
Figure 29:
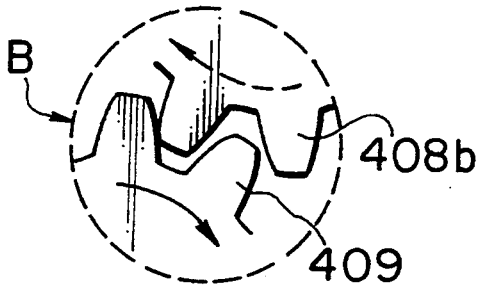
FIG. 29 is an enlarged detail view of the area designated B in FIG. 27.

A power transmission mechanism used in a seventh embodiment of the present invention will is shown in FIGS. 27 to 29. In the illustrated construction, two groups of gears are used in place of the two timing belts 58*a*, 58*b* and the pulleys forming the groups a and b shown in FIG. 24. That is, in FIG. 27, a motor-side gear 408*a* and a roller-side gear 409 constitute a group a, and a motor-side gear 408*b* and the roller-side gear 409 constitute a group b.

A shown in FIG. 28, the motor-side gear 408*a* is driven by a main motor 10*a* to rotate only in a direction as shown by the solid arrow, while, as shown in FIG. 29, the motor-side gear 408*b* is driven by a main motor 10*b* to rotate only in a direction as shown by the broken arrow. When the motor-side gear 408*a* is driven to rotate in the direction of the solid arrow so as to transport the printing paper 7 in the upstream direction, the other motor-side gear 408*b* is under follower rotation by being driven by the roller-side gear 409. On the other hand, when the motor-side gear 408*b* is driven to rotate in the direction of the broken arrow so as to transport the printing paper 7 in the downstream direction, the motor-side gear 408*a* is under follower rotation by being driven by the roller-side gear 409.

By the function of the one-way clutches 406*a*, 406*b* and the non-rotatably fixed torque limiters 405*a*, 405*b*, a load is imparted to the motor-side gear 408*a* or 408*b* which is under follower rotation.

It will be seen from the above description that the meshing engagement between the gears in the two gear groups a and b does not change regardless of the direction of rotation of the main motor 10*a* and 10*b*, so that the transported distance of the printing paper 7 in the upstream direction does not appreciably differ from that in the downstream direction. In the power transmission mechanism shown in FIG. 27, the gear ratio in the group b need not necessarily be the same as that in the group a.

Figure 30:
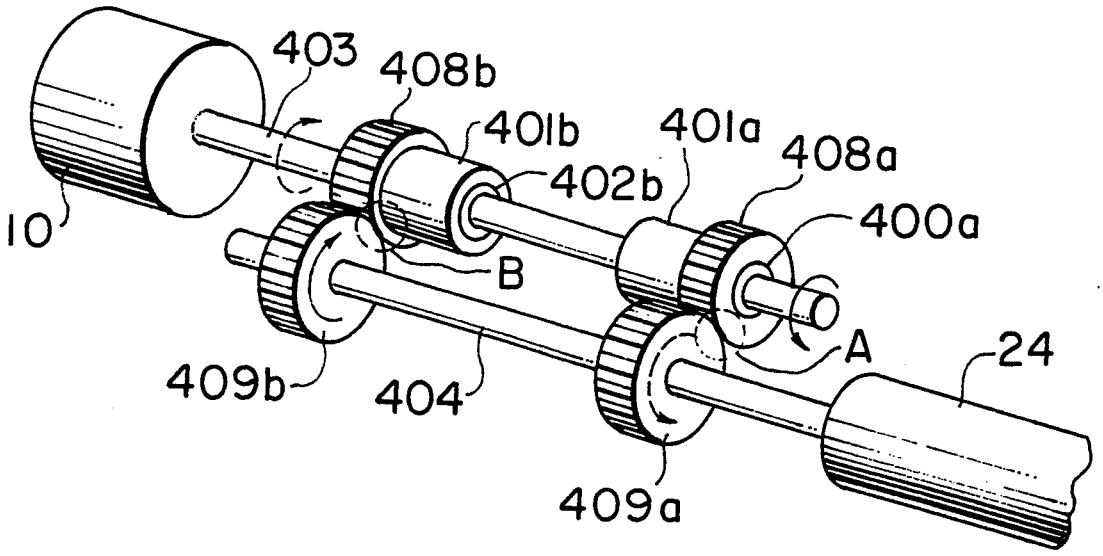
FIG. 30 is a schematic perspective view of a still further power transmission mechanism constructed in accordance with the present invention.
Figure 31:
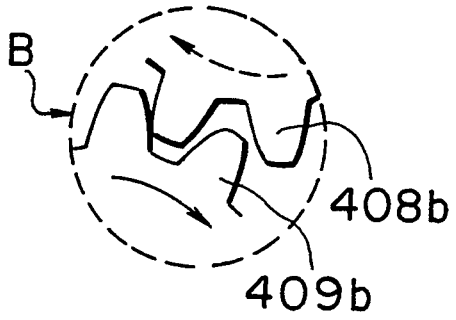
FIG. 31 is an enlarged detail view of the area designated B in FIG. 30.
Figure 32:
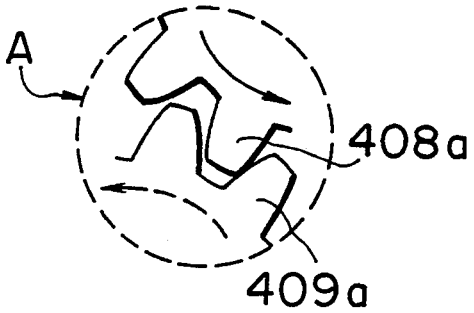
FIG. 32 is an enlarged detail view of the area designated A in FIG. 30.

A power transmission mechanism used in an eighth embodiment of the present invention will is shown in FIGS. 30 to 32. In the illustrated construction, two groups of gears are used in place of the two timing belts 58*a*, 58*b* and the pulleys forming the groups a and b shown in FIG. 24, as in the form shown in FIG. 27.

When the main motor 10 is rotating in the direction shown by the solid arrow so as to transport the printing paper 7 in the upstream direction, the drive power is transmitted through the one-way clutch 400*a* to a motor-side gear 408*a*, while no drive power is transmitted through the one-way clutch 400*b* to a motor-side gear 408*b*. The drive power is then transmitted from the motor-side gear 408*a* to a roller-side gear 409*a*, and the paper transport roller 24 is driven to rotate in the direction of transporting the printing paper 7 in the upstream direction. Thus, in the gear group a, the motor-side gear 408*a* makes meshing engagement with the roller-side gear 409*a* as shown in FIG. 32. A roller-side gear 409*b* is driven by the rotation of the roller-side gear 409*a*, while the motor-side gear 408*b* is under follower rotation. Thus, in the gear group b, the motor-side gear 408*b* makes meshing engagement with the roller-side gear 409*b* as shown in FIG. 31.

On the other hand, when the main motor 10 is rotating in the direction shown by the broken arrow so as to transport the printing paper 7 in the downstream direction, the drive power is transmitted through the one-way clutch 400*b* to the motor-side gear 408*b*, while no drive power is transmitted through the one-way clutch 400*a* to the motor-side gear 408*a*. The drive power is then transmitted from the motor-side gear 408*b* to the roller-side gear 409*b*, and the paper transport roller 24 is driven to rotate in the direction of transporting the printing paper 7 in the downstream direction. The roller-side gear 409*a* is driven by the rotation of the roller-side gear 409*b*, while the motor-side gear 408*a* is placed under follower rotation. As in the case of the fifth embodiment described above, the torque limiters 401*a* and 401*b* impart the load to the gears placed under follower rotation respectively. It will be seen from the above description that the state of meshing engagement between the two gear groups a and b does not change regardless of the direction of rotation of the main motor 10.

Figure 33:
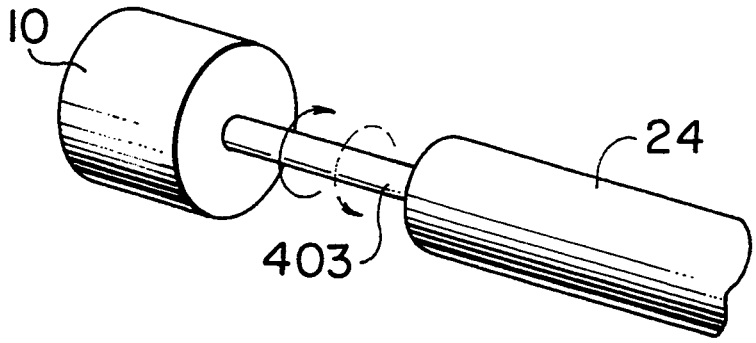
FIG. 33 is a schematic perspective view of yet another power transmission mechanism constructed in accordance with the present invention.

In the power transmission mechanism. of FIG. 33, the paper transport roller 24 is directly mounted on the shaft 403 of the main motor 10.

It will be understood from the foregoing detailed description of the thermal printer of the present invention that undesirable curling of a printing paper can be reliably prevented by rewinding or heating the printing paper prior to the printing operation.

We claim:

1. A thermal printer comprising a printing-paper supply roll having a printing paper wound therearound in a roll, transporting means for transporting the printing paper supplied from said printing-paper supply roll, a thermal head including an array of heat generating elements for printing an image on the printing paper, a cylindrical platen roller disposed opposite to the heat generating elements of said thermal head, and driving means for driving said printing paper, wherein said printing paper is taken up on said printing-paper supply roll by driving said printing-paper supply roll when said thermal printer is placed in a standby mode for more than a predetermined period of time.

2. A thermal printer according to claim 1, wherein, after said printing paper is taken up on said printing-paper supply roll, a leading end of the printing paper is located at a position nearer to said printing-paper supply roll than a position of a point of pressure contact between said cylindrical platen roller and the heat generating elements of said thermal head.

3. A thermal printer according to claim 1, wherein said printing-paper supply roll is selectively rotatable in opposite directions.

4. A thermal printer according to claim 1, wherein said transporting means comprises a transporting roller, a main motor means for rotating and driving said transporting roller, and timing belt means for forming a power transmission mechanism for transmitting power from said main motor means to said transporting roller, said timing belt means being maintained in a tensioned state and slackened state corresponding to a tensioned state and slackened state immediately before a beginning of printing on the printing paper as when the thermal printer is in a print mode.

5. A thermal printer according to claim 1, wherein said transporting means comprises a transporting roller, a main motor means for rotating and driving said transporting roller, and a timing belt means forming a power transmission mechanism for transmitting a power from said main motor means to said transporting roller, and wherein, immediately before printing on the printing paper in a print mode, the printing paper is transported by said transporting means in a direction opposite to a printing transport direction of the printing paper.

6. A thermal printer according to claim 1, wherein said transporting means comprises a transporting roller, a main motor means for rotating and driving said transporting roller, and a plurality of timing belt means forming a power transmission mechanism for transmitting power from said main motor means to said transporting roller, wherein said timing belt means is maintained in a tensioned state immediately before a beginning of a printing on the printing paper as when the thermal printer is placed in a print mode.

7. A thermal printer according to claim 6, wherein two main motor means are provided, each of said main motor means being rotated and driven in directions opposite to each other, and wherein said two motor means rotate and drive said transporting roller through respective timing belt means.

8. A thermal printer according to claim 6, wherein two motor-side pulleys are provided, each of said motor-side pulleys including a one-way clutch associated therewith and mounted on a shaft of said main motor, said one-way clutches being arranged so as to transmit drive power of said main motor in directions opposite to each other, and wherein said motor-side pulleys respectively drive said transport roller through said two timing belt means.

9. A thermal printer according to claim 1, wherein said transporting means includes a transporting roller, and wherein a main motor means is provided for rotating and driving said transporting roller.

10. A thermal printer according to claim 1, wherein said driving means includes torque controlling means for applying tension to said printing paper when the printing paper between said printing-paper supply roll and said transporting means is taken up on the printing-supply roll.

11. A color thermal printer comprising a color printing paper, a thermal head including an array of heat generating elements for printing an image on the printing paper, a cylindrical platen roller disposed opposite to the heat generating elements of said thermal head, transporting means for selectively transporting the printing paper in opposite directions, a main motor driving said transporting means, and power transmission means for transmitting the drive power of said main motor to said transporting means, said power transmission means including a timing belt tensioned in one of an upper run and lower run thereof and slackened in the other of the upper run and lower run, said timing belt being maintained in a same tensioned state and slackened state immediately before printing each of individual colors on the printing paper is started when said thermal printed is placed in a print mode.

12. A color thermal printer according to claim 11, wherein, immediately before said each of the individual colors is to be printed on the printing paper in the print mode, the printing paper is transported by said transporting means in a direction opposite to a direction in which the printing paper is transported for printing.

13. A color thermal printer comprising a color printing paper, a thermal head including an array of heat generating elements for printing an image on the printing paper, a cylindrical platen roller disposed opposite to the heat generating elements of said thermal head, transporting means including a transport roller for selective transporting of the printing paper in opposite directions, two main motors driving said transporting means, and power transmission means including timing belts for respectively transmitting drive power of said two main motors to said transporting means, wherein two motor-side pulleys each having a one way clutch associated therewith are mounted on a shaft of each of said main motors, and said two main motors rotate in directions opposite to each other so as to drive said transport roller through said two timing belts respectively.

14. A color thermal printer comprising a color printing paper, a thermal head including an array of heat generating elements for printing an image on the printing paper, a cylindrical platen roller disposed opposite to the heat generating elements of said thermal head, transporting means including a transport roller for selective transporting of the printing paper in opposite directions, a main motor driving said transporting means, and power transmission means transmitting drive power of said main motor to said transporting means, said power transmission means including two timing belts for driving said transport roller, and wherein two motor-side pulleys each having a one-way clutch associated with a shaft of said main motor are provided, said one way clutches are arranged so as to selectively transmit drive power of said main motor in opposite directions, and said motor-side pulleys respectively drive said transport roller through said two timing belts.

15. A color thermal printer comprising a color printing paper, a thermal head including an array of heat generating elements for printing an image on the printing paper a cylindrical platen roller disposed opposite to the heat generating elements of said thermal head, transporting means including a transport roller for selective transporting the printing paper in opposite directions, and a main motor driving said transporting means, said main motor being selectively rotatable in opposite directions, and said transport roller being directly mounted on a shaft of said main motor to be selectively be rotated in opposite directions by said main motor.

16. A thermal printer comprising a printing paper supply roll having a printing paper wound therearound in the form of a roll, transporting means for transporting the printing paper supplied from said printing paper supply roll, a thermal head including an array of heat generating elements for printing an image on the printing paper, a cylindrical platen roller disposed opposite to the heat generating elements of said thermal head, rewinding means for rewinding the printing paper on said printing paper supply roll when the thermal printer is placed in stand-by mode over more than a predetermined period of time, and a heat roller for heating the printing paper.

17. A thermal printer comprising a printing paper supply roll having a color printing paper wound therearound in the form of a roll, transporting means for transporting the printing paper supplied from said printing paper supply roll, a thermal head including an array of heat generating elements for printing an image on the printing paper, a cylindrical platen roller disposed opposite to the heat generating elements of said thermal head, rewinding means for rewinding the printing paper on said printing paper supply roll when the thermal printer is place in stand-by mode over more than a predetermined period of time, a heat roller for heating the printing paper, and a power transmission means for transmitting drive power of a motor to said transporting means.

18. A thermal printer comprising a printing paper supply roll having a color printing paper wound therearound in the form of a roll, transporting means for transporting the printing paper supplied from said printing paper supply roll, a thermal head including an array of heat generating elements for printing an image on the printing paper, a cylindrical platen roller disposed opposite to the heat generating elements of said thermal head, rewinding means for rewinding the printing paper on aid printing paper supply roll when the thermal printer is placed in stand-by mode over more than a predetermined period of time, and power transmitting means for transmitting a drive power of a motor means to the transporting means including belt means for driving a transport roller of said transporting means.

* * * * *